US006340223B1

(12) United States Patent
Hirata

(10) Patent No.: US 6,340,223 B1
(45) Date of Patent: Jan. 22, 2002

(54) INK-JET HEAD AND FABRICATION METHOD OF THE SAME

(75) Inventor: Susumu Hirata, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/585,406

(22) Filed: Jun. 2, 2000

(30) Foreign Application Priority Data

| | | |
|---|---|---|
| Jun. 28, 1999 | (JP) | 11-181038 |
| Sep. 29, 1999 | (JP) | 11-276705 |
| Oct. 22, 1999 | (JP) | 11-300424 |

(51) Int. Cl.[7] ..... B41J 2/05
(52) U.S. Cl. ..... 347/56
(58) Field of Search ..... 347/54, 56, 55, 347/62

(56) References Cited

U.S. PATENT DOCUMENTS

| | | | | |
|---|---|---|---|---|
| 5,719,604 A | | 2/1998 | Inui et al. | |
| 5,812,163 A | | 9/1998 | Wong | |
| 5,988,799 A | * | 11/1999 | Abe et al. | 347/68 |
| 6,130,689 A | * | 10/2000 | Choi | 347/55 |

FOREIGN PATENT DOCUMENTS

| | | |
|---|---|---|
| EP | 0634273 | 1/1995 |
| FR | 2760404 | 9/1998 |
| GB | 2322831 | 9/1998 |
| JP | 2003054 | 1/1990 |
| JP | 7227968 | 8/1995 |
| JP | 2769447 | 11/1996 |
| JP | 8309980 | 11/1996 |

* cited by examiner

*Primary Examiner*—John Barlow
*Assistant Examiner*—Michael S. Brooke

(57) ABSTRACT

A heater portion including a heating element is arranged between two substrates with a void and a cavity interposed therebetween. When the heater portion is heated by voltage application to the heating element and reaches the bubbling temperature, the ink filling the cavity gives off bubbles so that ink droplets are ejected from the nozzle. The heater portion elastically buckles projected downwards due to thermal stress when the heater portion reaches the buckling temperature. When heater portion reaches the heating temperature, the mid part of the heater portion comes into contact with the top surface of the substrate so as to release heat from the heater portion through the substrate. At this moment, the heater is cooled down rapidly when the voltage application to the heater is stopped.

21 Claims, 17 Drawing Sheets

| Thinness L/H | Buckling temperature Tc(℃) | Heating temperature T(℃) | Power consumption P(W) |
|---|---|---|---|
| 31.3 | 186 | 223 | 0.6 |
| 27.0 | 251 | 288 | 0.9 |
| 24.3 | 309 | 346 | 1.2 |
| 22.4 | 363 | 400 | 1.5 |
| 21.0 | 413 | 450 | 1.8 |
| 19.9 | 460 | 497 | 2.1 |
| 19.0 | 505 | 542 | 2.4 |

303
102
Plane 303-304
Plane 301-302
108a
108a
102
102
108a
301
302
304

102
104c
104c
108a
102
102

102
Ni
Ta
Ta
Ni
102
102

104a
104a
131
104a 104a
104b
104a
131
104b
104a
104b 104a
108
104a
102
108
102

104d
104b
104d
104b 105
107
103
107
105a
103
107
102
105
102

INK-JET HEAD AND FABRICATION METHOD OF THE SAME

BACKGROUND OF THE INVENTION (1) Field of the Invention

The present invention relates to a thermal type ink-jet head for recording an image on a recording medium by ejecting ink droplets from an ejection nozzle by the pressure rise occurring when bubbles arise in the ink which is heated by a heating element.

(2) Description of the Prior Art

As the recording head used in a printer for forming an image on a recording medium, thermal type ink-jet heads have been used which eject ink droplets from an ejection nozzle by the pressure rise occurring when bubbles arise in the ink which is heated by a heating element. In a thermal type ink-jet head, a pulse current is supplied to a heating element arranged on the substrate in accordance with the image data, the heating element heats so that the ink being in contact with the heating element is heated giving off bubbles. Generation and expansion of the bubbles causes pressure rise, whereby ink in the ejection nozzle is ejected out as ink droplets. This ink droplet jumps to the recording medium placed in proximity to the ejection nozzle, creating a recording dot in an image as a recording pattern.

In the thermal type ink-jet head, part of the heat generated from the heating element dissipates by way of the substrate. Therefore, in order to eject a sufficient amount of ink for image forming on the recording medium, a large amount of current needs to be supplied to the heating element, giving rise to a drawback of the electric power consumption being increased.

Japanese Patent Application Laid-Open Hei 7 No.227968 discloses a configuration in which a space as a thermally insulating layer is formed between a heating element (heater) and a substrate so that heat arising from the heating element will not transfer to the substrate.

Japanese Patent Application Laid-Open Hei 2 No.3054 discloses a configuration in which a pressure generating means composed of a vibration plate and a heating layer is provided in the form of a cantilever structure or a simple beam supported at both ends and an electric current is supplied to the heating layer so as to cause a heat distortion within the pressure generating means and thereby deform and displace the pressure generating means in the nozzle plate direction, thus causing ink droplets to jump outside.

Registered Japanese Patent publication No.2769447 discloses a configuration in which two layers having different thermal conductivities are formed between a heating element and a substrate so as to inhibit thermal transfer from the heating element to the substrate.

However, since, with the above ink-jet head, heat arising from the heating element is hard to be released to the exterior, the heat generated while the heat element is energized remains in the heating element after removal of the electric supply. Therefore, even if the current is supplied in pulses to the heating element, the heat builds up in the heating element, elevating the temperature of the heating element, thus causing an overheated state. In this way, the ink-jet head has the drawback of overheating which will lower the response of the heating element, resulting in deficiency in the exact control of the ejected amount of ink.

In the configuration disclosed in Japanese Patent Application Laid-Open Hei 2 No.3054, since the pressure generating member is of a cantilever structure or of a beam supported at both ends, the pressure acting on the ink varies depending upon the positions along the beam, presenting poor ink ejection efficiency.

SUMMARY OF THE INVENTION

It is therefore an object of the present invention to provide an ink-jet head which can efficiently heat the ink with heat generated from a heating element while the voltage is applied and hence can reduce the electric power consumption and which can reduce the temperature of heating element rapidly while the voltage is not applied, whereby it is possible to exactly control the ejected amount of ink by making the response frequency of the heating element substantially equal to the frequency of the pulse voltage to be applied to the heating element, thus improving the ink ejection response to the print data.

As the means for solving the above drawbacks, the present invention is configured as follows:

In accordance with the first aspect of the present invention, an ink-jet head for ejecting ink by heating and bubbling ink, includes: a heating element to which electric current is supplied so as to heat and bubble the ink; and a head substrate having a void formed between the heating element and the head substrate, and is characterized in that the heating element will buckle into the void by thermal expansion accompanying the temperature rise thereof.

In accordance with the second aspect of the present invention, the ink-jet head having the above first feature is characterized in that the heating element comprises: a heater; a protective film for protecting the heater; and an insulation film for insulating the heater and the above components are formed of materials having approximately equal coefficients of linear expansion to each other.

In accordance with the third aspect of the present invention, the ink-jet head having the above first feature is characterized in that the heating element is arranged with its movement constrained at both ends with respect to the direction of the thickness and the direction perpendicular to the thickness.

In accordance with the fourth aspect of the present invention, the ink-jet head having the above first feature is characterized in that the heating element is configured so as to come into contact with the head substrate when buckled into the void.

In accordance with the fifth aspect of the present invention, the ink-jet head having the above first feature is characterized in that the void is arranged so as to communicate with a cavity that stores ink.

In accordance with the sixth aspect of the present invention, the ink-jet head having the above first feature is characterized in that the head substrate has a communication hole for establishing communication between the void and the exterior.

In accordance with the seventh aspect of the present invention, an ink-jet head for ejecting ink by heating and bubbling ink, includes: a heating element to which electric current is supplied so as to heat and bubble the ink; and a head substrate having a void formed between the heating element and the head substrate, and is characterized in that the heating element is provided in a bimetal configuration made up of multiple kinds of metals so as to cause the heating element to deform into the void by the temperature rise thereof.

In accordance with the eighth aspect of the present invention, an ink-jet head for ejecting ink by heating and bubbling ink, includes: a heating element to which electric current is supplied so as to heat and bubble the ink; and a head substrate having a void formed between the heating element and the head substrate, and is characterized in that the heating element is formed with a shape memory alloy layer which will deform into the void when the heating element exceeds a predetermined temperature.

In accordance with the ninth aspect of the present invention, an ink-jet head for ejecting ink by heating and bubbling ink, includes: a heating element to which electric current is supplied so as to heat and bubble the ink; a head substrate having a void formed between the heating element and the head substrate; and a piezoelectric actuator which pushes and deforms the heating element toward the void.

In accordance with the tenth aspect of the present invention, an ink-jet head for ejecting ink from a nozzle by heating and bubbling ink, includes: a first substrate; a second substrate arranged opposing the first substrate, defining a space to be filled with ink in corporation with the first substrate; and a heating element disposed between the first and second substrates and having a voltage selectively applied thereto so that the ink inside the space is heated and bubbled, and is characterized in that the heating element is arranged between the first and second substrates with clearances from both, and the heating element comes closer to or in contact with the first or second substrate by elastic deformation occurring from thermal stress during heating.

In accordance with the eleventh aspect of the present invention, the ink-jet head having the above tenth feature is characterized in that the elastic deformation is elastic buckling that occurs when the temperature of the heating element reaches the predetermined temperature.

In accordance with the twelfth aspect of the present invention, the ink-jet head having the above tenth feature is characterized in that the first or second substrate has an opposing surface which allows area contact with the heating element when it is elastically deformed.

In accordance with the thirteenth aspect of the present invention, the ink-jet head having the above tenth feature is characterized in that the heating element is provided in the form of a plate that is fixed at both ends with respect to at least one direction within the surface thereof opposing the first or second substrate.

In accordance with the fourteenth aspect of the present invention, the ink-jet head having the above thirteenth feature is characterized in that the heating element is provided in the form of a plate that is fixed at the entire periphery of the surface thereof opposing the first or second substrate and held between the first and second substrates.

In accordance with the fifteenth aspect of the present invention, the ink-jet head having the above tenth feature is characterized in that the heating element elastically deforms by thermal stress arising at a temperature approximately equal to the bubbling temperature of the ink.

In accordance with the sixteenth aspect of the present invention, the ink-jet head having the above tenth feature is characterized in that the heating element has been previously given an internal stress causing compression with respect to one direction within the surface thereof opposing the first or second substrate.

In accordance with the seventeenth aspect of the present invention, the ink-jet head having the above tenth feature is characterized in that the heating element is provided in the form of a plate having a multi-layered configuration in which an internal stress has been previously given so as to determine the direction of elastic deformation when the heating element heats.

In accordance with the eighteenth aspect of the present invention, an ink-jet head for ejecting ink includes: an ejection nozzle for ejecting ink: an ink chamber arranged in communication with the ejection nozzle; and a heating element disposed in the ink chamber, which gives off bubbles by heating the ink in contact with the heating element by selective activation and causes ink ejection from the ejection nozzle making use of the pressure arising when the bubbles expand, and is characterized in that the heating element elastically deforms toward the ink chamber when it reaches the predetermined temperature.

In accordance with the nineteenth aspect of the present invention, the ink-jet head having the above eighteenth feature is characterized in that a void is formed below the heating element.

In accordance with the twentieth aspect of the present invention, the ink-jet head having the above nineteenth feature is characterized in that the void is made in communication with the exterior.

In accordance with the twenty-first aspect of the present invention, the ink-jet head having the above eighteenth feature is characterized in that the heating element abuts the surface of the ink chamber opposing the heating element when the heating element reaches the predetermined temperature.

In accordance with the twenty-second aspect of the present invention, the ink-jet head having the above twenty-first feature is characterized in that the ink chamber has an opposing surface which opposes the heating element so as to allow area contact with the heating element when the heating element is elastically deformed.

In accordance with the twenty-third aspect of the present invention, the ink-jet head having the above eighteenth feature is characterized in that the heating element has a multi-layered configuration in which the outermost layer facing the interior of the ink chamber has been previously given an internal stress causing compression.

In accordance with the twenty-fourth aspect of the present invention, the ink-jet head having the above eighteenth feature is characterized in that the heating element is fixed at the entire periphery thereof to the bottom face of the ink chamber.

In accordance with the twenty-fifth aspect of the present invention, the ink-jet head having the above eighteenth feature is characterized in that the heating element is of an approximately circular shape.

In accordance with the twenty-sixth aspect of the present invention, a fabrication method of an ink-jet head, includes the steps of: forming an void-forming material and a heating element on the top of a first substrate, in this sequential order; removing the void-forming material; and arranging a second substrate a predetermined distance away from the top surface of the heating element.

In accordance with the twenty-seventh aspect of the present invention, the fabrication method of an ink-jet head having the above twenty-sixth feature is characterized in that the formation of the heating element includes an electrolytic plating step with such a current density that the plated layer will have an internal stress causing compression.

In accordance with the twenty-eighth aspect of the present invention, the fabrication method of an ink-jet head having the above twenty-sixth feature is characterized in that the formation of the heating element includes electrolytic plating steps using different current densities.

According to the above first configuration, heat diffusion from the heating element is prevented by the insulating effect of the void when ink is heated, enabling its sharp temperature rise. After ink ejection, the heating element buckles so that heat from the heating element is released through the head substrate to lower the temperature of the heating element rapidly.

In the above second configuration, it is possible to prevent occurrence of cracks due to repeated heat cycles.

In the above third configuration, it is possible to positively cause the heating element to buckle toward the void.

In the above fourth configuration, heat from the heating element can be well dissipated through thermal conduction via its contact with the head substrate.

In the above fifth configuration, the ink functions as the heat transfer medium when the heating element release heat thus improving the heat transfer to the head substrate and hence enabling beneficial heat radiation.

In the above sixth configuration, heat inside the void can be released outside through the communication hole.

In the above seventh, eighth and ninth configurations, it is possible to positively perform deformation of the heating element into the void.

In the above tenth configuration, the heating element arranged out of contact with the first and second substrates elastically deform by thermal stress during heating into contact with the first or second substrate. Therefore, the heat generated in the heating element will not dissipate through the substrate while the heating element heats, thus making it possible to efficiently heat the ink in contact with the heating element. On the other hand, heat remaining in the heating element after the completion of heating of the heating element will be dissipated through the first or second substrate in contact, thus making it possible to cool down the heating element quickly.

In the above eleventh configuration, the heating element quickly deforms by elastic buckling when the heating element reaches the predetermined temperature. Therefore, the heating element can be set quickly closer to or brought into contact with the first or second substrate in response to the temperature change.

In the above twelfth configuration, the heating element which has elastically deformed by its own heat comes into area contact with the first or second substrate. Therefore, a large amount of heat can be released from the heating element through the first or second substrate in contact, thus making it possible to cool down the heating element quickly.

In the above thirteenth configuration, the heating element is fixed at both ends with respect to at least one direction within its surface opposing the first or second substrate so that the heating element will not be moved at both ends by thermal deformation during heating. Therefore, the mid part of the heating element moves closer to or into contact with the first or second substrate by the elastic deformation arising during heating.

In the above fourteenth configuration, the heating element is fixed at the entire periphery of its surface opposing the first or second substrate and held between the first and second substrates so that the heating element will not move at the periphery thereof by thermal deformation during heating. Therefore, the central part of the heating element moves closer to or into contact with the first or second substrate by the elastic deformation arising during heating.

In the above fifteenth configuration, the heating element moves closer to or brought into contact with the first or second substrate by elastic deformation when the ink has been heated approximately close to the bubbling temperature. Therefore, the heating element cools down by the heat radiation of the first or second substrate immediately after the ejection of bubbling ink from the nozzle.

In the above sixteenth configuration, the heating element before heating has been previously given a residual stress causing compression with respect to one direction within the surface thereof opposing the first or second substrate. Therefore, the heating element elastically deforms in a reliable manner by the thermal stress arising in the compressing direction during heating.

In the above seventeenth configuration, the heating element is provided in the form of a plate having a multi-layered configuration in which an internal stress has been given previously in its unheated state so as to determine the direction of elastic deformation when the heating element heats. Therefore, the heating element will positively deform in the predetermined direction when it is heated.

In the above eighteenth configuration, the heating element for heating the ink and giving off bubbles in order to eject the ink from the ejection nozzle will elastically deform toward the interior of the ink chamber when it is activated and reaches the predetermined temperature.

Therefore, the pressure arising when bubbles expand and the pressure arising when the heating element elastically deforms act on the ink and hence the ink droplets can be ejected outside the ink-jet head by the combined pressure. This configuration contributes to reduce the current to be supplied to the heating element to bubble the ink, thus making it possible to reduce the power consumption.

In the above nineteenth configuration, the void is formed below the heating element provided in the in chamber. This void functions as the insulation layer when the heating element heat by supplying a pulse of current. Therefore, heat diffusion from the heating element to the substrate can be inhibited, thus enabling sharp temperature rise of the heating element.

In the above twentieth configuration, the void provided below the heating element is put in communication with the exterior. Therefore, it is possible to prevent reduction in the pressure in the void, which enables smooth elastic deformation of the heating element.

In the above twenty-first configuration, when the heating element is heated and reaches the predetermined temperature by supplying electric current, the heating element elastically deforms by thermal stress and comes into contact with the surface of the ink chamber opposing the heating element. Therefore, heat arising in the heating element is released through the abutment of the heating element with the surface of the ink chamber opposing the heating element, thus making it possible to cool the heating element quickly after the generation of bubbles. As a result, an improved heating and cooling response to the selectively activated pulse current can be achieved, thus making it possible to control the ejected amount of ink with high precision.

In the above twenty-second configuration, the heating element having been elastically deformed by heating comes into area contact with the opposing surface which opposes the heating element. Therefore, the heating element can be brought into contact with the surface opposing the heating element through an enlarged area, thus improving the heat radiation efficiency and enabling rapid cooling of the heating element.

Further, in this configuration, the surface of the ink chamber opposing the heating element is made of metal. That is, the heating element which has been elastically deformed by its heating abuts or comes closer to the metal-made opposing surface of the ink chamber, the heat arising in the heating element can be released quickly.

According to the above twenty-third configuration, in the heating element having a multi-layered configuration, the outermost layer facing the interior of the ink chamber has been previously given an internal stress causing compression. Therefore, the heating element will always deforms elastically in the fixed direction when the heating element is heated by supplying current and reaches the elastically deforming temperature.

In the above twenty-fourth configuration, the heating element provided in the ink chamber is fixed at the entire periphery thereof to the bottom face of the ink chamber. Therefore, it is possible to positively deform the heating chamber towards the interior of the ink chamber when it elastically deforms from heating. No leakage of ink from the periphery of the heating element will occur when the elastic element elastically deforms.

In the above twenty-fifth configuration, the heating element arranged in the ink chamber is formed in an approximately circular shape. This configuration provides large displacement of the heating element when it is elastically deformed, compared to other shapes having the same area. Therefore, it is possible to apply a greater pressure on the ink in the ink chamber.

In the above twenty-sixth configuration, a void can be formed between the heating element and the first substrate by removing the void-forming material from the top surface of the first substrate after the formation of the heating element. Therefore, it is possible to easily fabricate an ink-jet head having a void between the first substrate, and the second substrate and the heating element.

In the above twenty-seventh configuration, the heating element is formed as a plated layer by electrolytic plating so as to previously give an internal stress causing compression to the heating element. That is, the heating element during heating receives internal stress acting in the compressive direction, in addition to the thermal stress due to heating. Accordingly, the temperature for causing the heating element to deform into the predetermined shape when heated can be lowered.

In the above twenty-eighth configuration, the heating element is formed by electrolytic plating using different current densities which affect the internal stresses to be given to the plated layers. That is, multiple layers having different internal stress states can be formed. Therefore, it is possible to provide an ink-jet head having a heating element which deforms in a univocal direction determined by the stress states of the individual layers inside the heating element when thermal stresses arise due to heating.

DESCRIPTION OF THE PREFERRED EMBODIMENTS

Figure 1:
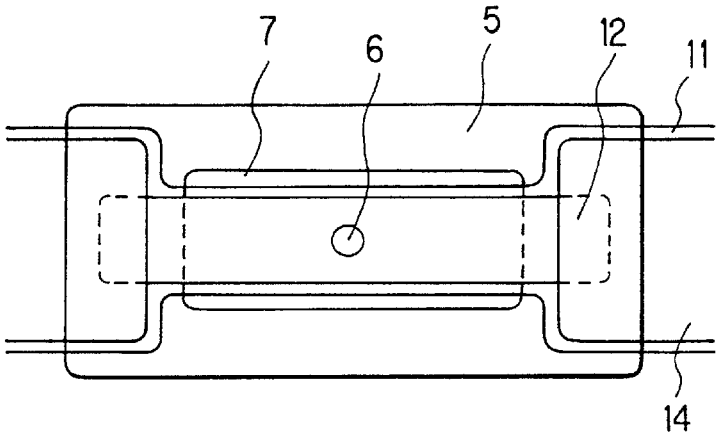
FIG. 1 is a top view showing the first embodiment of an ink-jet head of the present invention.
Figure 2:
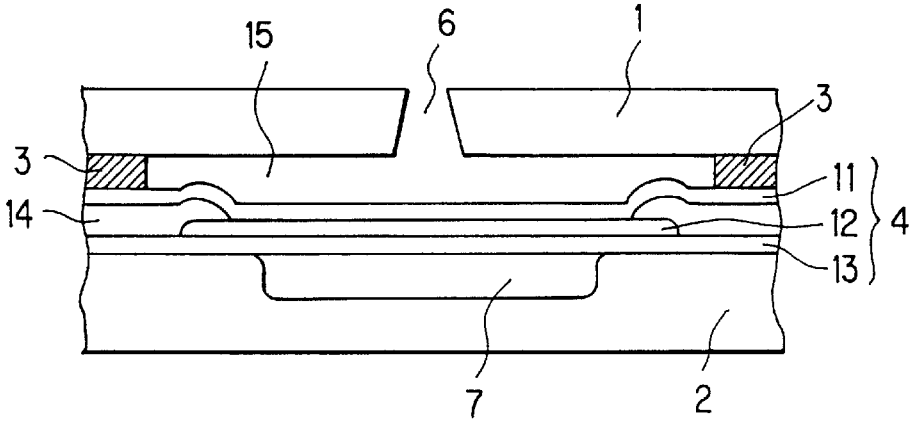
FIG. 2 is a sectional view showing the first embodiment of an ink-jet head of the present invention.

As an ink-jet head of the present invention, a typical bubble jet type ink-jet head in accordance with the first embodiment will be described with reference to FIGS. 1 and 2. FIGS. 1 and 2 are top and sectional views showing an ink-jet head of the first embodiment.

In the ink-jet head in the first embodiment, a heating element 4 is arranged between a nozzle plate 1 and a substrate 2 with spacers 3, 3 disposed between the nozzle plate and heating element 4.

Formed between spacers 3 and 3 is a cavity 5 to be filled with ink while a nozzle 6 through which the ink is ejected is formed at the center of nozzle plate 1.

A void 7 is formed as a thermally insulating layer under heating element 4. This void 7 is a space which is defined by a depressed portion formed in substrate 2 and between substrate 2 and heating element 4. This void 7 has the function of reducing the heat conduction between heating element 4 and substrate 2.

The ink-jet head having the above configuration is constructed so that, upon ink ejection, a pulse of current is supplied from an unillustrated pulse generating power source so as to give off a pulse of heat from heating element 4. This heat vaporizes the ink within cavity 5 in an instant and forms bubbles therein to thereby eject ink from nozzle 6.

Next, heating element 4 of this ink-jet head will be described.

As shown in FIG. 2, heating element 4 is fixed with both ends fixed between spacer 3 and substrate 2 and is composed of a protective film 11, a heater 12 and an insulating film 13.

This protective film 11 is to prevent adherence of ink in cavity 5 to heater 12. Insulation film 13 is to prevent electric leakage of the pulse current applied to heater 12 toward substrate 2. Heater 12 is configured of a metal thin-film having a high coefficient of thermal expansion and a high electric resistance.

Heater 12 is adapted to give off heat by the application of a pulse current from the pulse generating power source so that the entire heating element 4 will be heated to a temperature (to be referred to hereinbelow as the bubbling temperature) which will permit the ink in cavity 5 to bubble by film boiling.

Arranged at both ends of heater 12 are interconnections 14 for supplying the pulse current from the pulse generating power source to heater 12.

Further, when the temperature of heating element 4 exceeds the bubbling temperature, heater 12 buckles due to heat energy (thermal expansion) so that the entire shape of heating element 4 deforms with its part put into contact with substrate 2.

Figure 3:
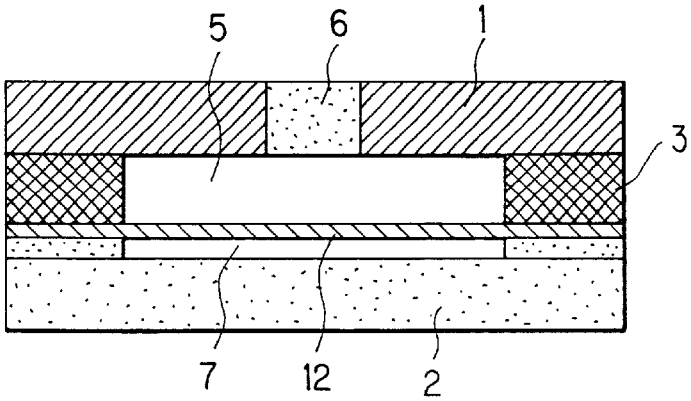
FIG. 3 is an illustrative view showing the first embodiment of an ink-jet head of the present invention, where the heat element is thermally insulated.
Figure 4:
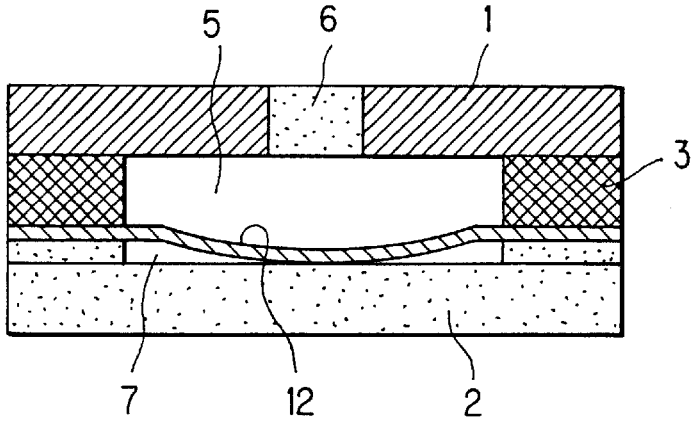
FIG. 4 is an illustrative view showing the first embodiment of an ink-jet head of the present invention, where the heat element radiates heat.

Illustratively, as shown in FIG. 3, heating element 4 is kept horizontal (i.e., thermally insulated) with respect to substrate 2 at a temperature below the bubbling temperature. With its temperature exceeding the bubbling temperature, heater 12 will buckle, as shown in FIG. 4, and heating element 4 will be set flexed to the void 7 side until it comes into contact with substrate 2. That is, this flexure brings part of heating element 4 (heater 12) into contact with substrate 2 (into its heat radiating state). Thus, the heat from heating element 4 (heater 12) is dissipated to substrate 2 and discharged, so that heating element 4 will return to the thermally insulated state shown in FIG. 3.

Heater 12 is composed of nickel of 6.5 $\mu$m thick and 150 $\mu$m long, and heats to about 500° C. providing the buckling start temperature of 370° C., to perform ink ejection.

Nozzle plate 1 may be formed of a stainless steel etching plate, nickel-electroformed plate, photosensitive glass, precision molded plastic, etc. For spacer 3. polyimide, nickel plating, dry film, etc. may be used. For protective film 11, polyimide, $SiO_2$, SiN, etc. may be used. For interconnection 14, Ta, Ni, Au, Al, etc. may be used. For heater 12, Ta, Ni, $HfB_2$, etc. may be used. For insulation film 13, polyimide, $SiO_2$, SiN, etc. may be used. For substrate 2, glass, ceramic, stainless steel, nickel, silicon, etc. can be used.

As above, the ink-jet head has void 7 between heating element 4 and substrate 2 so as to be able prevent heat conduction between heating element 4 and substrate 2. Therefore, it is possible to raise the temperature of heating element 4 in an instant to the bubbling temperature.

Further, as soon as it has reached the bubbling temperature, heating element 4 buckles together with buckling of heater 12 so that part of the heating element comes into contact with substrate 2 to radiate heat. Therefore, heat from heating element 4 is discharged in a short time and hence the temperature of heating element 4 lowers quickly whereby the heating element returns to the thermally insulated state.

According to the ink-jet head of the first embodiment, the response frequency of heater 12 can be set approximately equal to the frequency of the applied pulse current. Therefore, it is possible to markedly precisely control the ejected amount of ink.

Here, in the first embodiment where heating element 4 is composed of protective film 11, heater 12 and insulation film 13, it is preferred that their materials should have approximately equal coefficients of thermal expansion. This is to prevent occurrence of cracks due to repeated heat cycles.

It is also preferred that a silicone oil should be applied over the contact area between heating element 4 and substrate 2. This will promote heat diffusion from heating element 4 to substrate 2.

In the first embodiment, heating element 4 is fixed at both ends with spacer 3 and substrate 2. However, setting method of heating element 4 should not be limited to this. That is, heating element 4 may be set in any manner as long as heating element 4 is inhibited from moving in directions perpendicular to the thickness thereof (in the direction perpendicular to the document and the direction left and right direction in FIG. 2).

In the first embodiment, heater 12 is adapted to buckle and bring heating element 4 into contact with substrate 2 when the temperature of heating element 4 exceeds the buckling temperature.

However, buckling of heater 12 should not occur necessarily with a large deformation. In other wards, heater 12 may and should warp in a degree to reduce the distance between heating element 4 and substrate 2 when the temperature of heating element 4 exceeds the buckling temperature. That is, the reduced distance between heating element 4 and substrate 2 will be able to cool heating element 4 (heater 12) from thermal diffusion to substrate 2.

Figure 5:
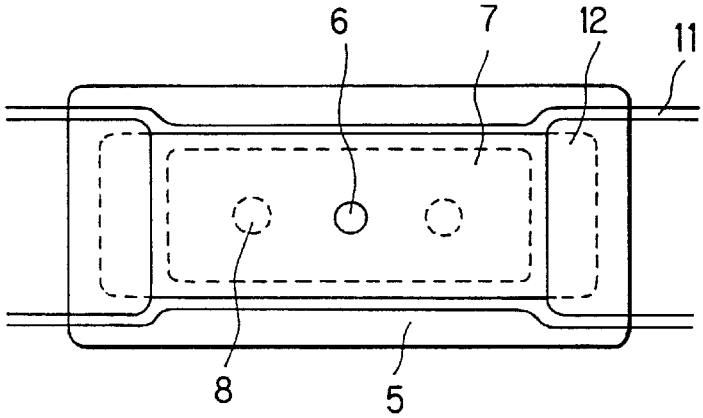
FIG. 5 is a top view showing the second embodiment of an ink-jet head of the present invention.
Figure 6:
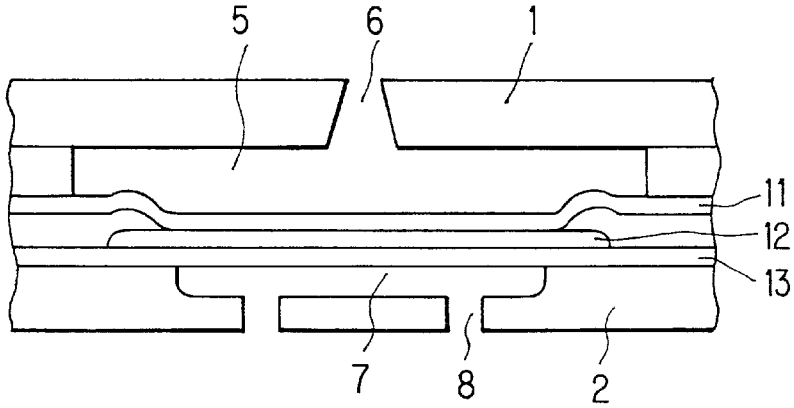
FIG. 6 is a sectional view showing the second embodiment of an ink-jet head of the present invention.

In the first embodiment, though void 7 is formed by a depressed portion in substrate 2, the configuration of void 7 should not be limited to this. For example, as is shown in the second embodiment with reference to FIGS. 5 and 6, communication holes 8 may be provided in substrate 2 so that void 7 and external air communicate with each other.

This configuration can avoid the pressure rise in void 7 which would occur due to the deformation of heating element 4 so that heating element 4 will easily buckle. Further, since the air in void 7 can be ventilated through communication holes 8, cooling of heating element 4 (heater 12) can be promoted.

It is also possible to provide a configuration so that void 7 communicates with cavity 5. In this case, void 7 will also be filled up with ink.

In the first embodiment, though heater 12 is composed of a metal membrane having a high coefficient of thermal expansion and a high electric resistance, heater 12 may be formed of a laminated film made up of multiple number of metal membranes.

Figure 7:
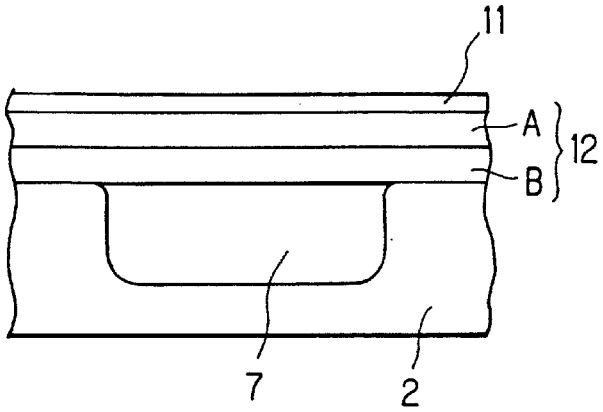
FIG. 7 is a sectional view showing the third embodiment of an ink-jet head of the present invention.

As shown in the third embodiment in FIG. 7, a lamination of two different kinds of metals A and B, having different rates of thermal expansion may be used as heater 12 (insulation film 13 is omitted in FIG. 7).

In this way, by providing heater 12 with a bimetallic configuration, it is possible to regulate the deforming direction of heater 12, in a controlled manner.

Figure 8A:
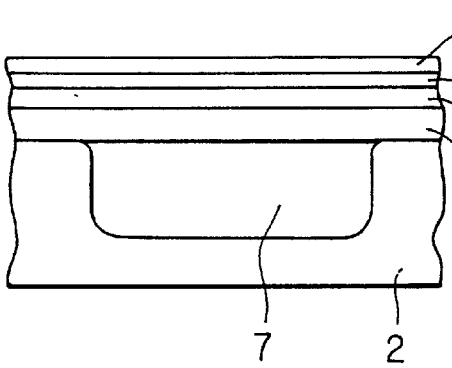
FIGS. 8A and 8B are sectional views showing the fourth embodiment of an ink-jet head of the present invention, where the heat element is thermally insulated and where the heat element radiates heat, respectively.
Figure 8B:
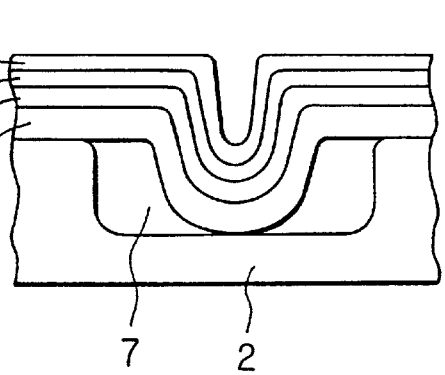

In the first embodiment, it is specified that heater 12 should buckle when the temperature of heater 12 exceeds the buckling temperature. However, this will not limit the configuration of heating element 4. For example, as in the fourth embodiment shown in FIGS. 8A and 8B, a thin film of a shape memory alloy (SMP) 15 may be provided in the lowermost layer of heating element 4.

That is, when shape memory alloy 15 is set so that it takes a parallel state with respect to substrate 2 at lower temperature (see FIG. 8A) and takes a deformed state when exceeding the deforming temperature (see FIG. 8B), it is possible to realize deformation and cooling of heating element 4 in a beneficial manner. Thus, when such a shape memory alloy 15 is used, there is no need to select a material having a high rate of thermal expansion for heater 12.

In the first embodiment, spontaneous shape deformation of heating element 4 is made use of in order to cool heater 12 when placing heating element 4 into contact with substrate 2. That is, the contact between heater 12.and substrate 2 can be attained by selecting a material for heater 12 or shape memory allow 15 so that it deforms into void 7 above the deforming temperature.

However, the ink-jet head of the first embodiment should not be limited to this. For example, the ink-jet head may employ a forcible thrusting method by using a piezoelectric actuator which forcibly pushes heating element 4 into void 7.

Figure 9:
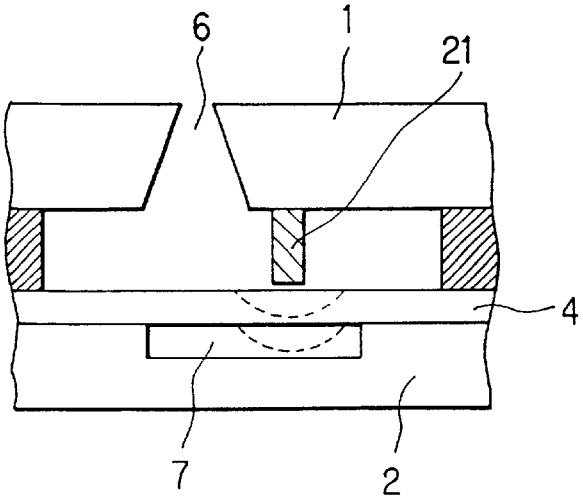
FIG. 9 is a sectional view showing the fifth embodiment of an ink-jet head of the present invention.

FIG. 9 is an illustrative view showing the fifth embodiment of an ink-jet head using this method. As shown in FIG. 9, in this configuration, a piezoelectric actuator 21 is arranged on nozzle plate 1 so that it is directed to heating element 4.

This piezoelectric actuator 21 is set so that it expand toward heating element 4 when a voltage from an unillustrated power source is applied thereto. Thus, heating element 4 is thrust into void 7 so as to come into contact with substrate 2.

This configuration enables contact between heating element 4 and substrate 2 without depending upon the material of heater 12 or without using SMP 15. Since the amount of displacement of heating element 4 and its contact time with substrate 2 can be selected at will, it is possible to control the response frequency of heater 12 at a markedly high accuracy, thus making it possible to adjust the ejected amount of ink with precision.

For piezoelectric actuator 21, a laminated piezoelectric actuator having multiple number of layered piezoelectric elements is preferably used. In this case, it is preferred that the displacement of the piezoelectric elements in the direction of their thickness is used to thrust heating element 4.

With this configuration, it is possible to set the applied voltage to piezoelectric actuator 21 at 40 V or below while achieving high-speed switching of the shape of piezoelectric actuator 21. Accordingly, it is possible to control the response frequency of heater 21 with a further enhanced accuracy.

As piezoelectric actuator 21, thin-film piezoelectric elements can be used. For example, in the sixth embodiment shown in FIG. 10, piezoelectric actuator 21 is provided in a laminated configuration (bimorph configuration) consisting of first and second piezoelectric films 22 and 23.

This piezoelectric actuator 21 is set so that first piezoelectric film 22 expands along the film surface thereof while second piezoelectric film 23 contracts in the same direction when the voltage is applied. In this arrangement, as the voltage is applied, an abutment point 31 formed at the end of piezoelectric actuator 21 presses down heating element 4 so as to achieve contact between heating element 4 and substrate 2. This configuration simplifies the ink-jet head configuration providing improved assembly workability.

Here, as the material of first and second piezoelectric films 22 and 23, PZT (lead zirconium titanate) can be used.

Figure 10:
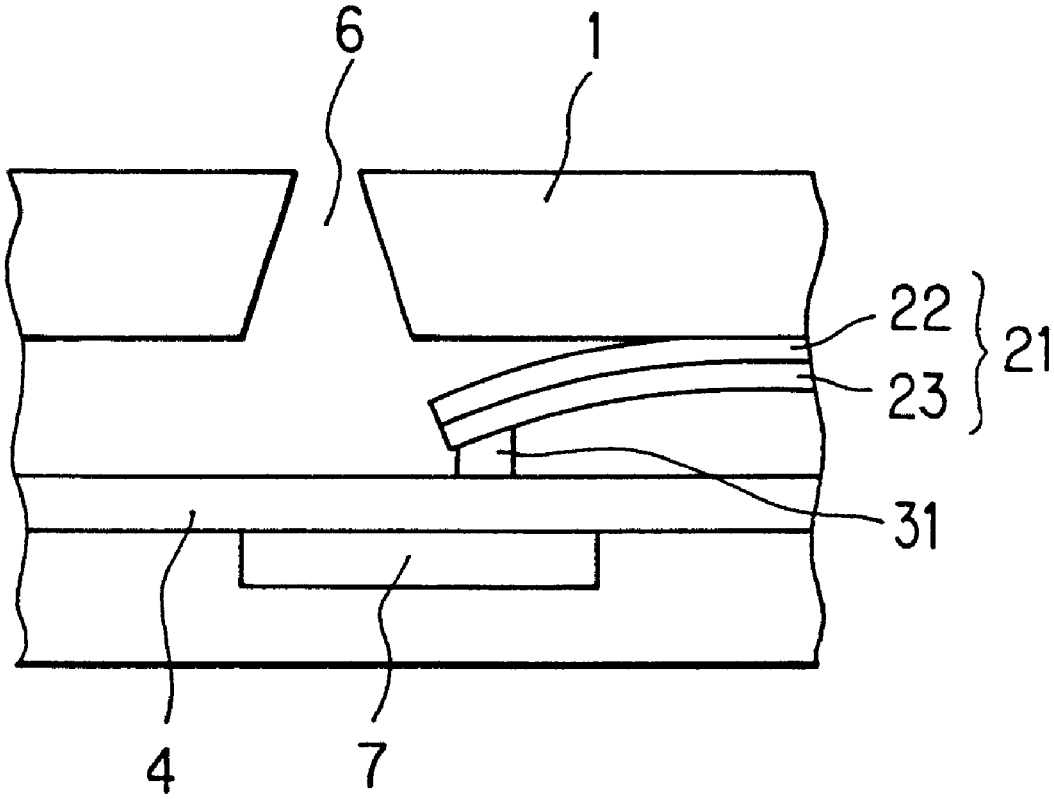
FIG. 10 is a sectional view showing the sixth embodiment of an ink-jet head of the present invention.

In the configuration shown in FIG. 10, instead of first piezoelectric film 22, a metal thin-film such as of stainless steel may be used (uni-morph configuration). Also in this configuration, it is possible to realize beneficial deformation or displacement of piezoelectric actuator 21 while simplifying the configuration of piezoelectric actuator 21 and hence reducing the manufacturing cost.

Figure 11A:
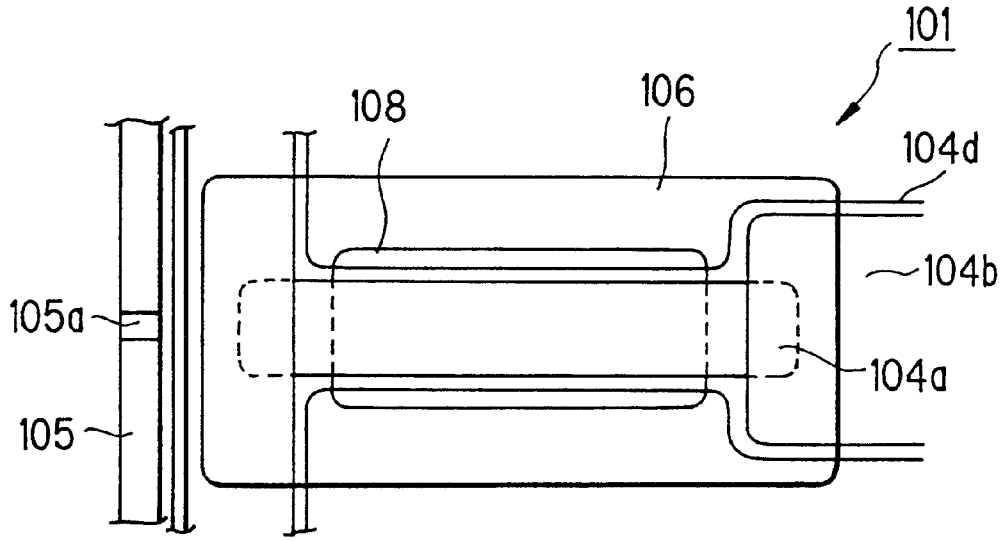
FIGS. 11A and 11B are sectional, plan and side views showing a configuration of an ink-jet head in accordance with the seventh embodiment of the present invention.
Figure 11B:
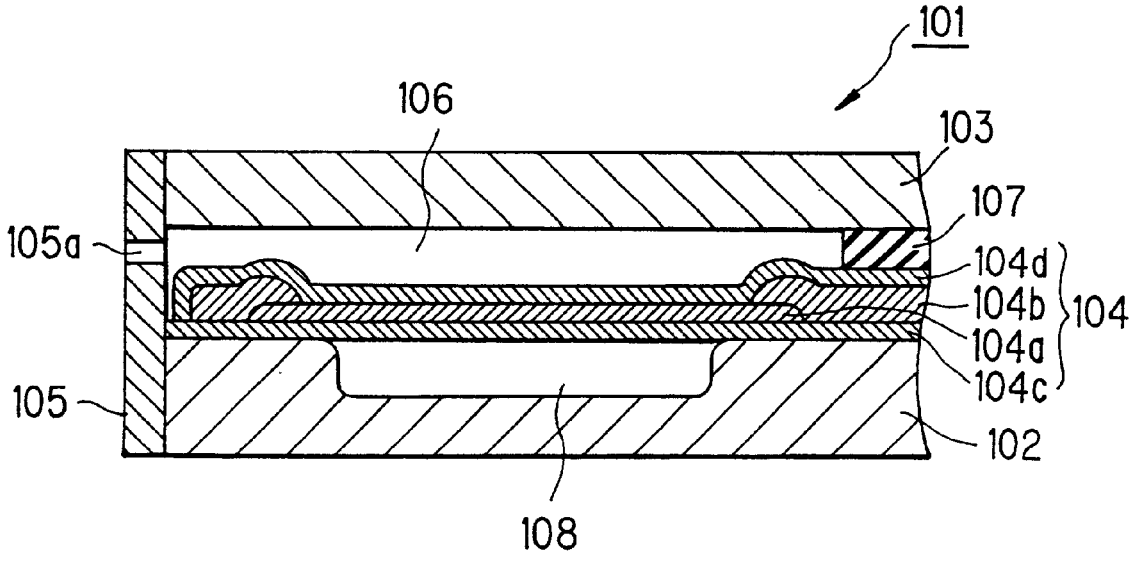

FIGS. 11A and 11B are sectional, plan and side views, respectively, showing a configuration of an ink-jet head in accordance with the seventh embodiment of the present invention. This ink-jet head 101 is configured so that a heater portion 104 is arranged between a first substrate 102 and a second substrate 103 with a nozzle plate 105 fixed to and along the one end face of substrates 102 and 103. Formed between substrates 102 and 103 is a cavity 106 which will be filled with liquid ink. A nozzle 105*a* which allows cavity 106 to communicate with the exterior is formed in nozzle plate 105. Heater portion 104 is disposed in cavity 106.

Heater portion 104 is composed of a heating element 104*a*, interconnections 104*b*, an insulation film 104*c* and a protective film 104*d*. Heating element 104*a* is formed of a thin plate made up of a metal such as Ni, etc., having a high coefficient of thermal expansion and a high electric resistance, and will heat by the electric supply of pulse current from an unillustrated drive circuit via interconnections 104*b* and bubbles the ink within cavity 106 by film boiling. Insulation film 104*c* provides electric insulation of heating element 104*a* and interconnections 104*b* from substrate 102. Protective film 104*d* provides watertightness of heating element 104*a* and interconnections 104*b* from and against the ink filling cavity 106.

A spacing wall 107 is arranged between the top surface of heater portion 104 and substrate 103. This spacing wall 107 forms the space constituting cavity 106 between heater portion 104 and substrate 103. A void 108 is defined by the upper surface of substrate 102 which is disposed below, and opposing, heating element 104*a* of heater portion 104. This void 108 is formed so as to reduce the contact area of the undersurface of heater portion 104 with substrate 102.

Accordingly, heat transfer of the heat generated from heating element 104*a* of heater portion 104 toward substrate 102 is reduced, while the ink inside cavity 106 is quickly heated as the temperature of heater portion 104 increases rapidly. Therefore, when a pulse of current is applied to heating element 104*a*, the ink in cavity 106 is heated in an instant, and gives off bubbles when the temperature of heating element 104*a* reaches the bubbling temperature Tb, to thereby eject ink from nozzle 105*a*. This bubbling temperature Tb is a temperature unique to the ink used.

One end in one direction within the surface, opposing substrates 102 and 103, of heater portion 104 abuts the inner surface of nozzle plate 105 while the other end is held between substrates 102 and 103 with spacing wall 107 interposed between substrate 103 and heater portion 104. Accordingly, movement of heater portion 104 is constrained at both ends with respect to the aforementioned one direction within the surface, opposing substrates 102 and 103, of heater portion 104.

Figure 12A:
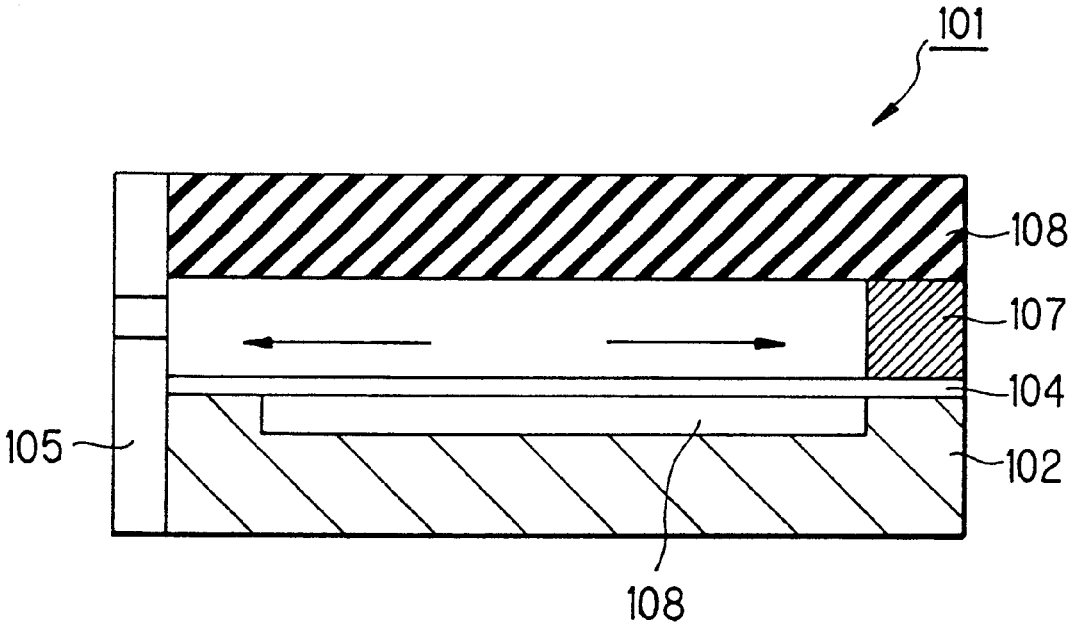
FIGS. 12A and 12B are sectional side views schematically showing the deformed state of a heater portion in the above ink-jet head.
Figure 12B:
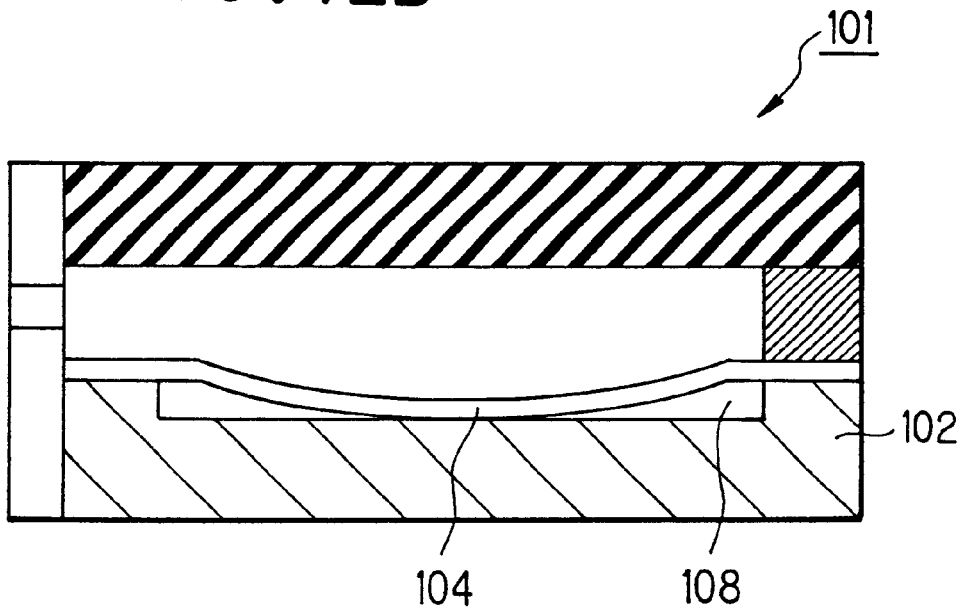

FIGS. 12A and 12B are sectional side views schematically showing the deformation of a heater portion in the above ink-jet head. From heat generated from heating element 104*a*, heater 104 tries to expand in the directions indicated by the arrows in FIG. 12A. However, since the displacement at both ends in the aforementioned one direction within the surface opposing substrates 102 and 103, a thermal stress occurs in the directions (contracting direction) shown by the arrows in FIG. 12A. This thermal stress increases with the temperature rise of heating element 104*a*, and when the temperature of heating element 104*a* reaches the predetermined buckling temperature Tc, heater portion 104 will elastically deform (elastically buckle) due to thermal stress. Therefore, the buckling temperature Tc is a temperature at which elastic buckling of heater portion 104 starts.

Specifically, when the temperature of heating element 104*a* is below the buckling temperature Tc, heater portion 104 remains between substrates 102 and 103 and in parallel thereto, as shown in FIG. 12A. When the temperature of heating element 104*a* reaches the buckling temperature Tc, heater portion 104 buckles with its central part projected to the substrate 102 side. When the temperature of heating element 104*a* has reached the heating temperature T which is higher than the buckling temperature Tc, heater portion 104 comes in contact with the upper surface of substrate 102 at its middle part as shown in FIG. 12B. Therefore, this heating temperature T is the temperature when heater portion 104 comes into contact with substrate 102 and heating element 104*a* receives electric supply of pulse current until it reaches the heating temperature T.

When the temperature of heating element 104*a* has reached the heating temperature T and its middle part comes into contact with the upper surface of substrate 102, heat arising in heating element 104*a* of heater portion 104 is discharged and conducted through substrate 102. If the supply of pulse current to heating element 104*a* is stopped at this moment, the temperature of heater portion 104 rapidly lowers. With this temperature drop, the thermal stress in heater portion 104 reduces whereby the heater portion 104 reverts back to its original state shown in FIG. 12A by its own elasticity.

In connection with the above, if the upper surface of substrate 102, which also defines the bottom surface of void 108 is made curved so that it abuts and fits the undersurface of heating portion 104 after deformation, heater portion 104 having reached at heating temperature T will be able to come into area contact with the upper surface of substrate 102, thus making it possible to efficiently discharge heat from heater portion 104.

As an example, heating element 104*a* is formed of nickel of 6.5 μm thick, 10 μm wide and 150 μm long. Insulation film 104*c* is formed of $SiO_2$ of 0.1 μm thick. Protective film 104*d* is formed of polyimide of 0.1 μm thick. The depth of void 108 is set at 5 μm. In this arrangement, as heater portion 104 is heated up to the heating temperature T (=500° C.) for the buckling temperature Tc (=370° C.), the ink inside cavity 106 gives off bubbles and hence ink is ejected from nozzle 105*a* while the middle part of heater portion 104 moves inside void 108 and comes into contact with the upper surface of substrate 102.

The buckling temperature Tc of heater portion 104 is given as follows:

$$Tc=(\pi^2/3\alpha)\times(H/L)^2 \qquad \text{formula (1)}$$

where H, L and α represent the thickness, length and coefficient of linear expansion of heater portion 104. The maximum displacement Ymax of heater portion 4 is given as follows:

$$Ymax=2qL/\pi_2 \qquad \text{formula (2).}$$

Here, q is determined using the heating temperature T, the buckling temperature Tc and the coefficient of linear expansion α of heater portion 104, from the following relations:

$$L(q) = \pi \cdot \alpha \cdot (T - Tc)/4$$

$$L(q) = \int_0^{\frac{\pi}{2}} \frac{q^2 \sin^2\phi}{\sqrt{1 - q^2 \sin^2\phi}}\, d\phi$$

Further, electric power consumption P is given as:

$$P=\rho\times H\times L\times D\times C\times T \qquad \text{formula (3),}$$

where H, L, D and C, ρ and T are the thickness, the length, width and specific heat, density and heating temperature of heater portion 104, respectively.

In heater portion 104, if insulation film 104*c* and protective film 104*d* are enough thin compared to heating element 104*a*, the deformed state of heater portion 104 is determined dedicatedly depending upon the material and shape of heating element 104*a*. For example, FIG. 13 shows the relationship between the temperature t of heater portion 104 and the amount of displacement Y for a heating element 104*a* of Ni with a coefficient of linear expansion a of $1.8\times10^{-5}$ and of 150 μm long(L) and 10 μm wide(D) when electric power consumption P is changed stepwise through 0.6 W, 0.9 W, 1.2 W, 1.5 W, 1.8 W, 2.1 W to 2.4 W and the thickness H is changed from 1.16 μm to 8.04 μm.

Figure 13:
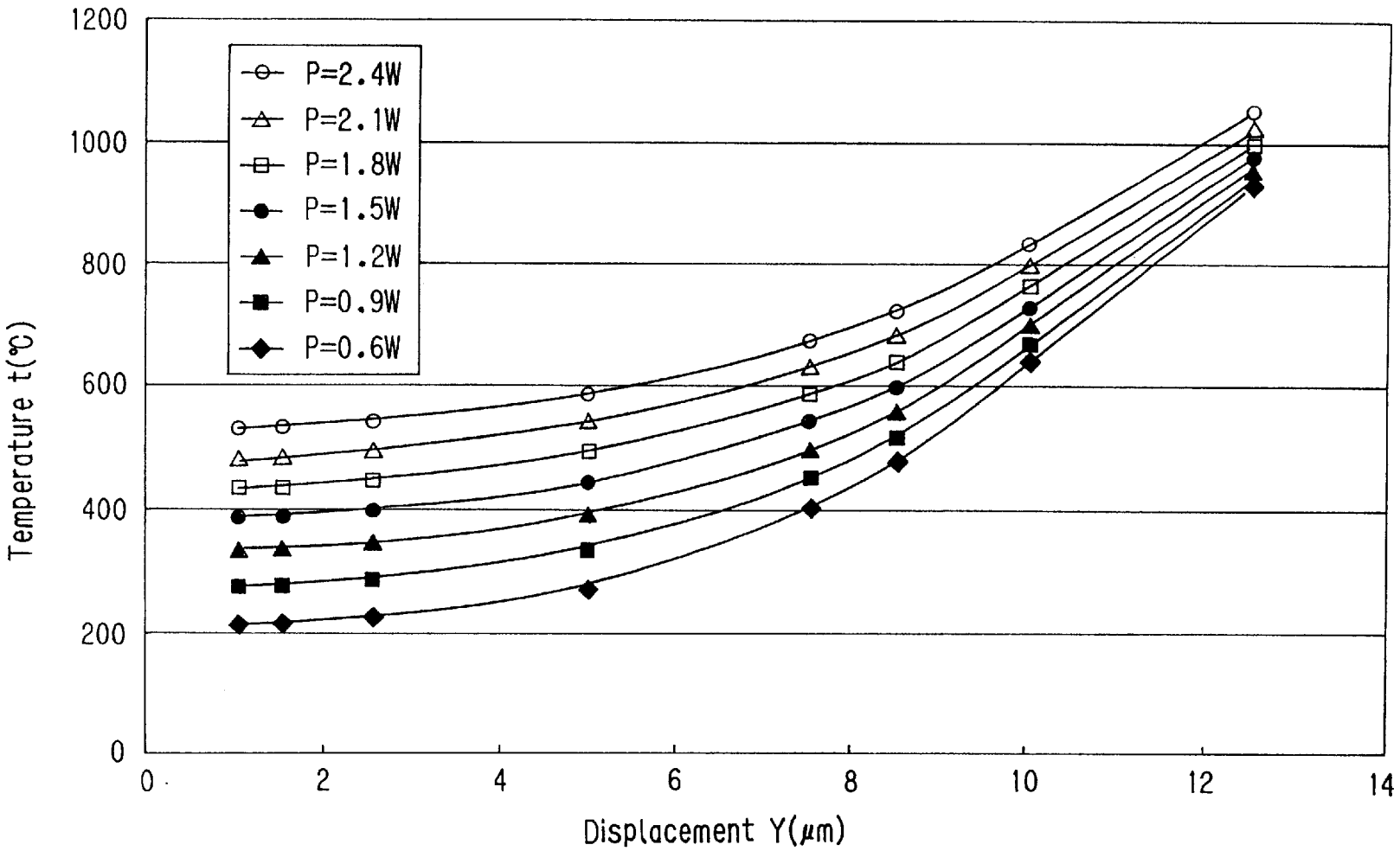
FIG. 13 is a chart showing the relationship between the temperature of the same heater portion and the amount of displacement.

As is apparent from FIG. 13, the lower the temperature t of heater portion 104, the smaller the amount of displacement Y. In order to provide an amount of displacement equal to or greater than 10 μm, heater portion 104 should be kept at an extremely high temperature, at 600° C. or higher. In order to save electric energy by reducing the power consumption P when heater portion 104 is moved within the void 8 into contact with substrate 102 by virtue of elastic deformation accompanying the temperature rise, the depth of void 8 should be 10 μm or smaller. When the depth of void 8 is set at 4 μm or smaller, the heating temperature T for causing heater portion 104 to come into contact with substrate 102 will not vary too much even if the depth of void 8 fluctuates when manufactured. Therefore, with this condition, it is possible to improve the production yield.

Figure 14:
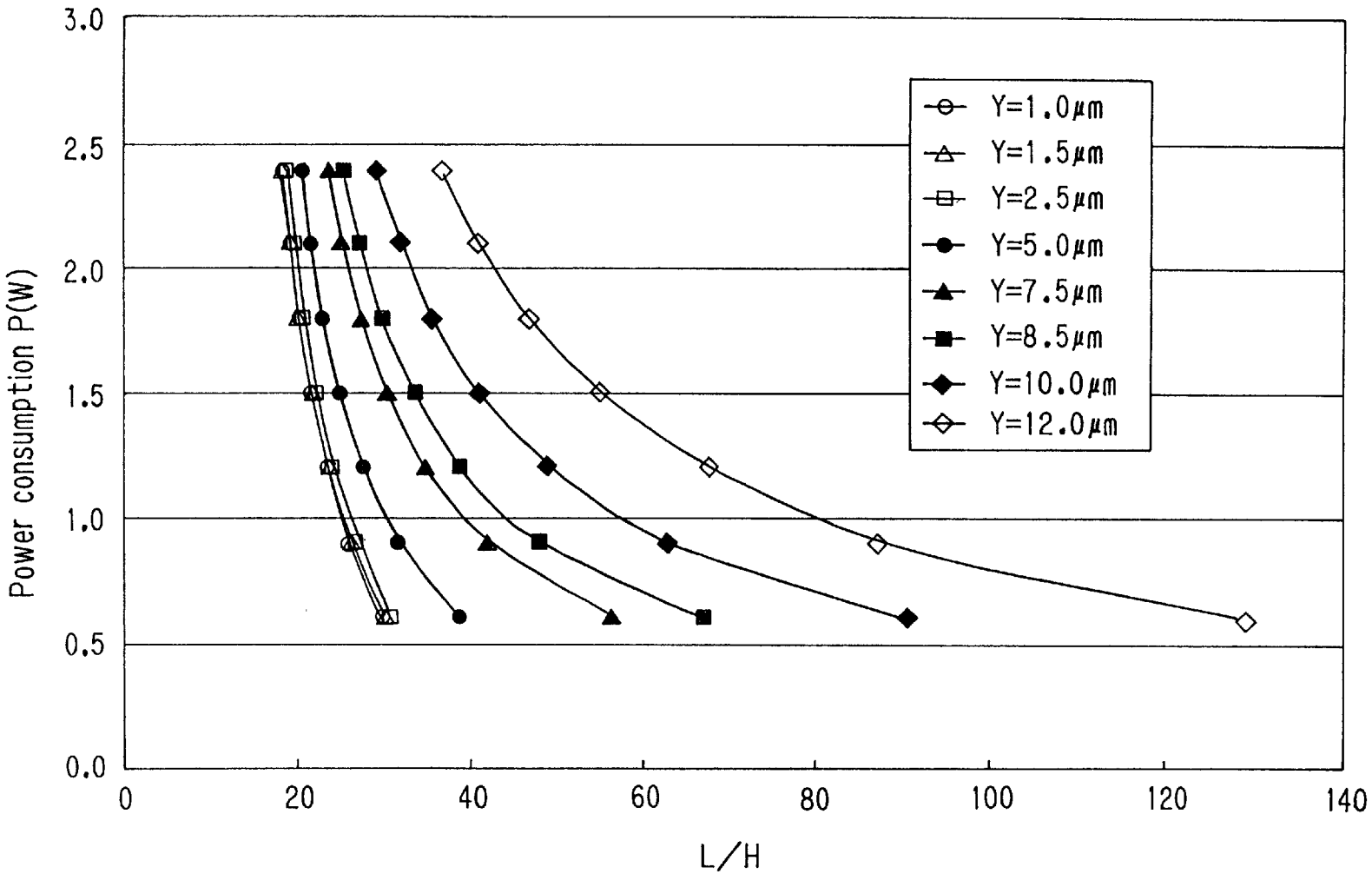
FIG. 14 is a chart showing the relationship between the thinness of the same heater portion and the electric power consumption.
Figure 15:
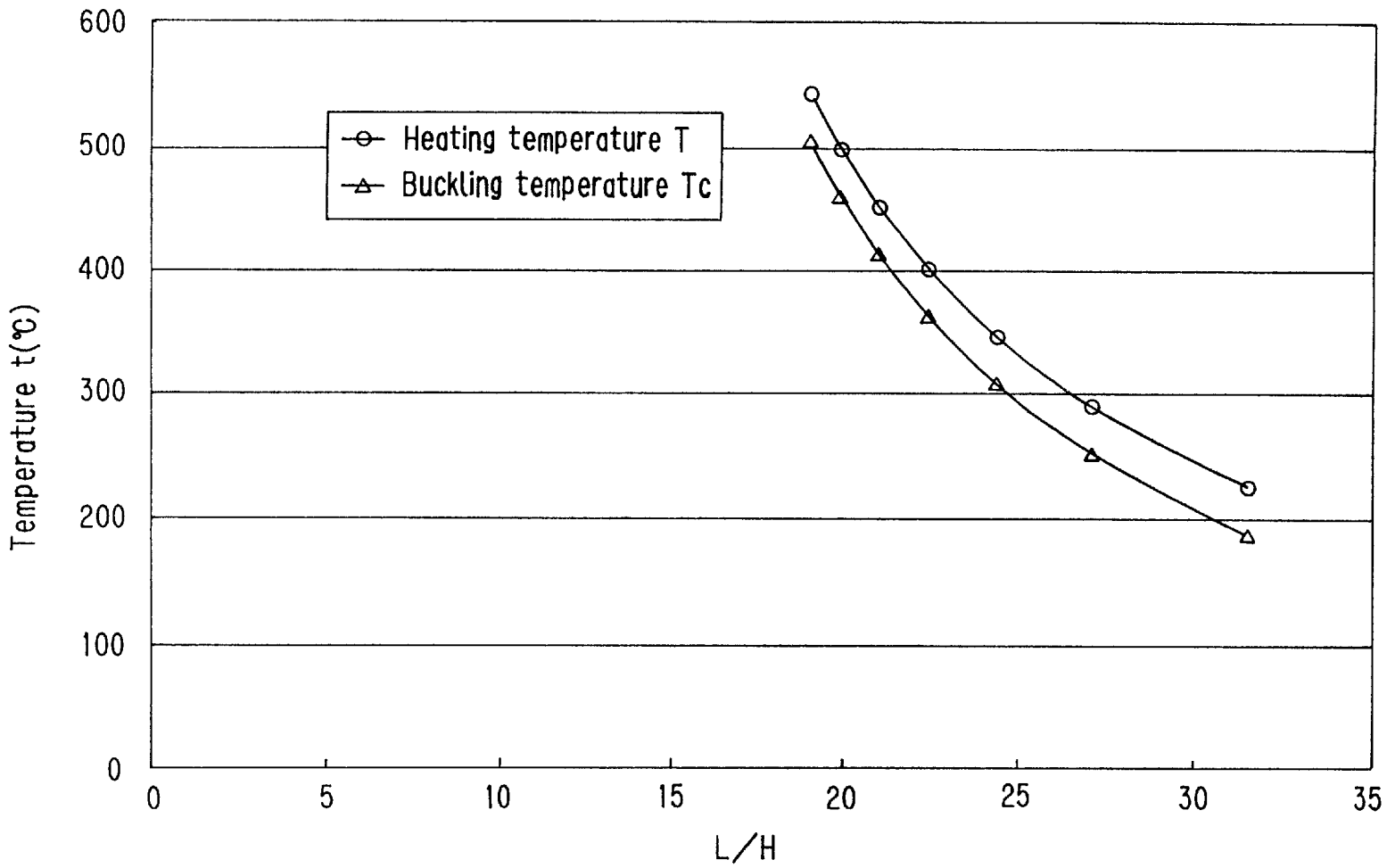
FIG. 15 is a chart showing the relationship between the thinness of the same heater portion, the heating temperature and the buckling temperature.
Figures 16, 17:
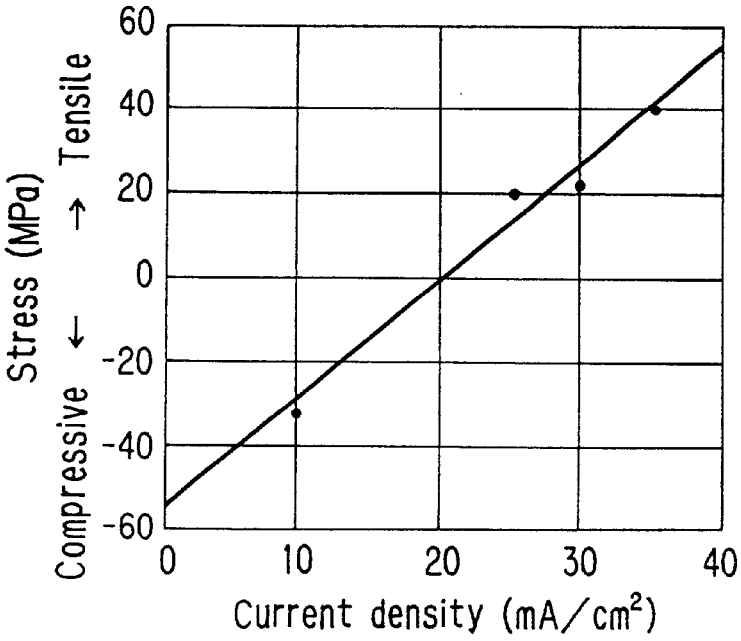
FIG. 16 is a chart showing the relationship between the thinness of the same heater portion, the buckling temperature, the heating temperature and the electric power consumption.
FIG. 17 is a chart showing the relationship between the current density and the internal stress arising in the plated layer formed by a typical Ni-electrolytic plating.

Next, FIG. 14 shows the relationship between the ratio (L/H: thinness) of the length of heater portion 104 to the thickness and power consumption P for a heater portion 104 of Ni with a coefficient of linear expansion a of $1.8\times15^{-5}$ and of 150 μm long (L) and 10 μm wide (D) when the amount of displacement Y is changed stepwise as 1.0 μm, 1.5 μm, 2.5 μm, 5.0 μm, 7.5 μm, 8.5 μm, 10.0 μm and 12.5 μm while the heating temperature T is changed from 212° C. to 1054° C. at each displacement. In particular, FIG. 15 shows relationships between the thinness L/H, and heating temperature T, and buckling temperature Tc when the displacement Y of heater portion 104 is at 2.5 μm. FIG. 16 shows a relationship between the thinness L/H, heating temperature T, buckling temperature Tc, and power consumption P.

As is apparent from FIGS. 14 to 16, as the thinness L/H of heater portion 104 becomes greater (as the heater portion 104 becomes thinner), heating temperature T and buckling temperature Tc become lower and hence the power consumption P becomes smaller. For example, with the depth of void 108 (the amount of displacement Y of heater portion 104) set at 2.5 μm, when a heater portion 104 having a thinness L/H of 19.0 (L (length of the heater portion 104)=150 μm, H (height)=7.9 μm) is used, buckling temperature Tc is equal to 505° C., heating temperature T is equal to 542° C. and power consumption P=2.4 W. When a heater portion 104 having a thinness L/H of 31.3 (L (length of the heater portion 104)=150 μm, H (height)=4.8 μm) is used, buckling temperature Tc is equal to 186° C., heating temperature T is equal to 223° C. and power consumption P=0.6 W. Accordingly, when a type of ink having a bubbling temperature Tb of 186° C. is used, the ink will be ejected when the temperature of the heater portion 104 reaches 186° C. and then the heater portion 104 will start to be cooled down after only a further temperature rise by 37° C. as it comes into contact with substrate 102 at that temperature.

With the depth of void 108 (the amount of displacement Y of heater portion 104) set at 10.0 μm, when a heater portion 104 having a thinness L/H of 29.3 (L (length of the heater portion 104)=150 μm, H(height)=5.1 μm) is used, buckling temperature Tc is equal to 212° C., heating temperature T is equal to 835° C. and power consumption P=2.4 W. Accordingly, when a type of ink having a bubbling temperature Tb of 212° C. is used, the ink will be ejected when the temperature of the heater portion 104 reaches 212° C. and then the heater portion 104 should be heated by 623° C. higher to bring heater portion 104 into contact with substrate 102 to cool it down.

From the above consideration, as the depth of void 108, or the amount of displacement Y of heater portion 104 is smaller, the thinness L/H of heating portion 104 can be increased. Thus, the depth of void 108 should be determined so that the thinness L/H value will be equal to 15 or more, preferably 20 or more. This setting makes for reduction in the power consumption P and the temperature variation of heater portion 104, thus improving the durability.

From the above formula (1), as the coefficient of linear expansion a becomes greater, heater portion 104 has a lower buckling temperature Tc. Particularly, if a heater portion 104 is formed of a material having a coefficient of linear expansion α of $\times 10^{-5}$/° C. or greater, elastic buckling occurs at a lower temperature, making it possible to provide an ink-jet head configuration which has a small power consumption P and hence can provide an excellent durability.

When a type of ink having its bubbling temperature Tb equal to the heating temperature T of heater portion 104 is used, heater portion 104 will come into contact with substrate 102 almost at the same time as the ink is ejected. Accordingly, it is possible to provide an ink-jet head configuration which has the heating temperature T lowered and hence can provide an excellent durability.

When a type of ink having its bubbling temperature Tb equal to the buckling temperature Tc of heater portion 104 is used, heater portion 104 will start deformation when the ink is ejected. That is, at that moment, the heater portion 104 has not yet come into contact with substrate 102. So, heater portion 104 will radiate a lowered amount of heat so that it is possible to reduce the power consumption for heating heater portion 104.

Further, an internal stress in the direction parallel to the top surfaces of substrate 101 and 102 may be previously given to heater portion 104 so that it is possible to lower the buckling temperature Tc of heater portion 104. For example, when heater portion 104 is formed by electrolytic plating, the formed heater portion 104 has an internal stress depending upon the current density as shown in FIG. 17. As an example, when heater portion 104 is formed by electrolytically plating in a nickel amidosulfonate bath (sulfamic acid Ni bath) having a pH of 4.4 with the current density set at 1 mA/cm$^2$ at a temperature of 50° C., the resultant heater 104 has a compressive stress of about 55 MPa acting in the surface direction. This compressive stress corresponds to the stress that would arise by a temperature rise of 14.6° C. in the following formula (4).

$$S=E\cdot\alpha\cdot T/(1+\alpha\cdot T) \qquad \text{formula (4)},$$

where

S: the stress in the plated layer (N/m$^2$)

E: Young's modulus ($2.1\times10^{11}$ N/m$^2$ for Ni)

α: coefficient of linear expansion (($1.8\times15^{-5}$/° C. for Ni)

T: temperature (° C.).

Therefore, the heater portion 104 prepared by the above electrolytic plating will start to deform at a temperature lower by 14.6° C. than that in the case where no internal stress is given. Therefore, lowering of the buckling temperature Tc and heating temperature T of heater portion 104 can improve the device in its durability and reduce the power consumption.

Figure 18A:
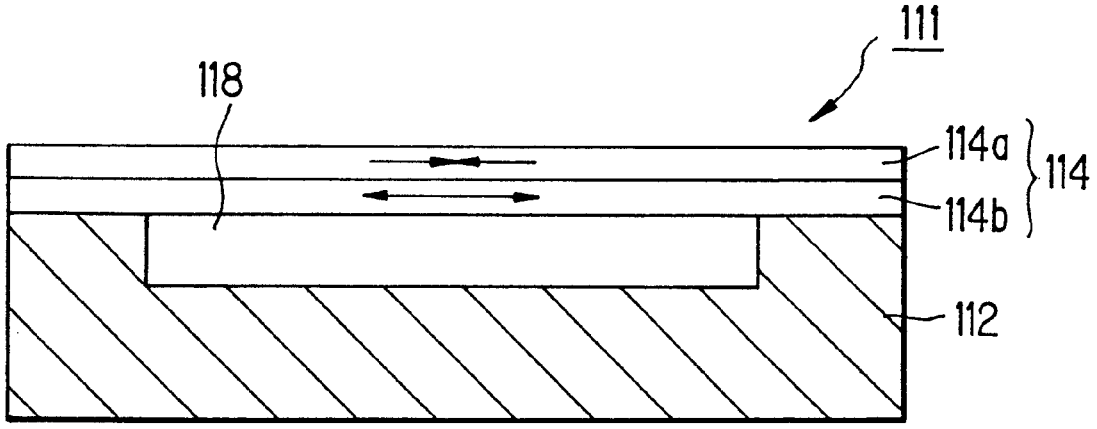
FIGS. 18A and 18B are sectional side views showing the essential components of ink-jet heads according to the eighth embodiment of the present invention.
Figure 18B:
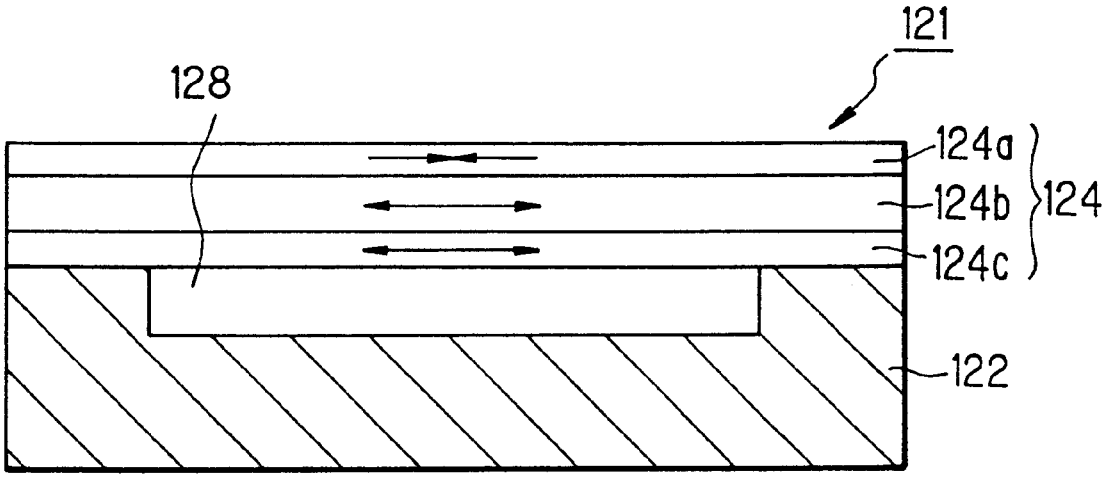

FIGS. 18A and 18B are sectional side views showing the essential components of ink-jet heads according to the eighth embodiment of the present invention. In the ink-jet heads according to this embodiment, the heater portion is composed of two or three layers. In an ink-jet head 111 shown in FIG. 18A, heater portion 114 is configured of two layers, i.e., an upper layer 114*a* and a bottom layer 114*b*, which have been previously given tensile and compressive stresses, respectively. In an ink-jet head 121 shown in FIG. 18B, heater portion 124 is configured of three layers, i.e., an upper layer 124*a*, and a middle layer 124*b* and a bottom layer 124*c*, which have been previously given tensile stresses and compressive stresses, respectively.

In the case where heater portion 114 or 124 has a multi-layered structure with each layer given a different internal stress as shown in FIGS. 18A and 18B, when a temperature rise causes compressive stresses to arise, the heater will buckle with its center projected to the side on which the layer, among the multiple layers in heater portion 114 or 124, receiving a stronger compressive stress is disposed. In order for heater portion 114 or 124 to maintain a stabilized state by canceling out the differential stress between the layers, the layer which has a stronger compressive stress acting thereon compared to the other layers should expand greater and hence the heater portion 114 or 124 will curve with the layer having the greater expansion outside.

Therefore, heater portion 114 or 124 always buckles with its lower layer 114*b* or 124*c*, which has a greater compressive stress acting thereon compared to that on the upper layer 114*a* or 124*a*, projected so that heater portion 114 or 124 will positively come into contact with the upper surface of substrate 112 or 122 having void 128 or 128 formed therein.

Figure 19A:
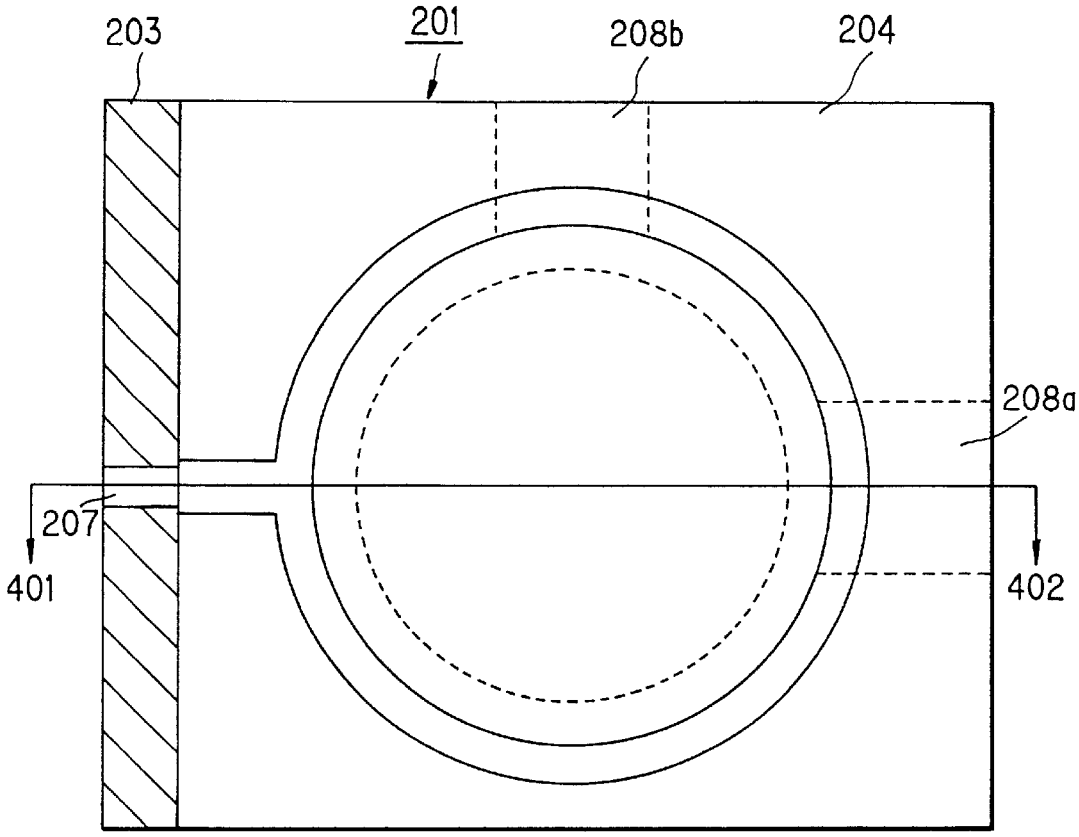
FIGS. 19A and 19B are plan and sectional views showing an ink-jet head according to the ninth embodiment of the present invention.
Figure 19B:
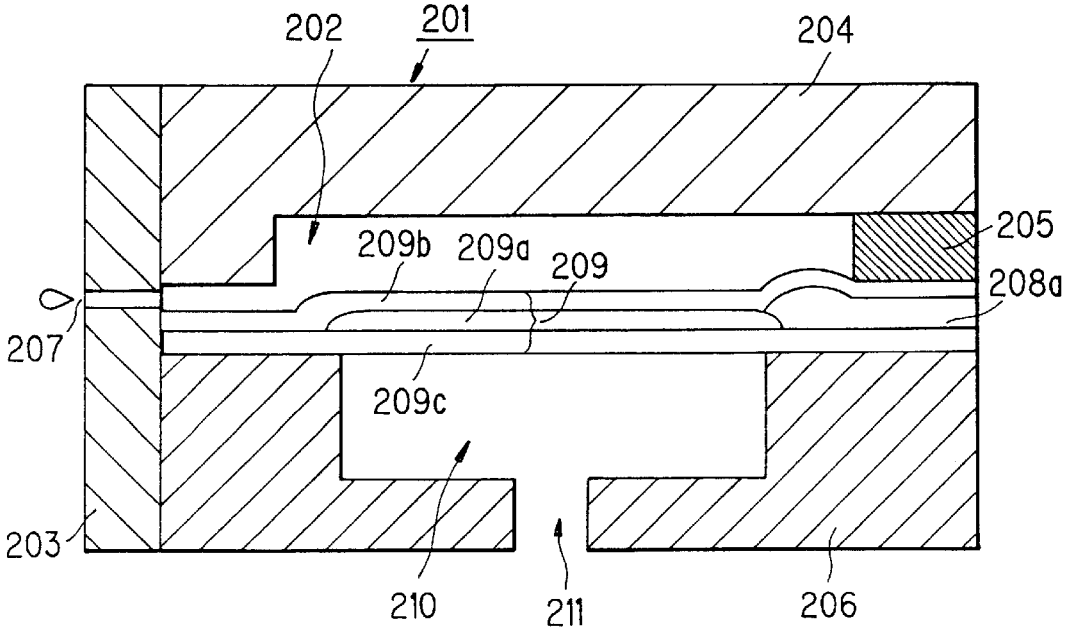

FIGS. 19A and 19B are a plan view and a sectional side view cut along a plane 401–402, showing an ink-jet head according to the ninth embodiment of the present invention. An ink-jet head 201 has a substrate 206, a spacing wall member 205 and a top plate 204 arranged in layers from the bottom to the top in this order. Provided on one of the end faces defined by substrate 206, spacing wall member 205 and top plate 204, which has an opening communicating with an ink chamber (also referred to as cavity) formed in spacing wall member 205, is a nozzle plate 203. This nozzle plate is attached to the end face as it is oriented perpendicular to the direction of lamination of substrate 206, spacing wall member 205 and top plate 204.

Formed on the top of substrate 206 are a heater portion 209, electrodes 208*a* and 208*b* together with an unillustrated drive circuit, etc. A space, enclosed by substrate 206, top plate 204 and nozzle plate 203 and heater portion 209, constituting ink chamber 202 is formed inside spacing wall member 205. Top plate 204 is a flat plate made up of a metal such as aluminum, iron, or the like. Nozzle plate 203 has an ejection nozzle 207 through which the ink inside ink chamber 202 is ejected. Ejection nozzle 207 provides communication between ink chamber 202 and ink-jet head 201.

Heater portion 209 is composed of a heating element 209*a*, a protective film 209*b* and an insulation film 209*c*. Heating element 209*a* is a thin plate having an approximately circular shape made up of a metal such as nickel, nickel-chromiumalloy, or the like, which has a high coefficient of thermal expansion and a high electric resistance.

Heating element 209*a* is connected with electrodes 208*a* and 208*b* and heats when an unillustrated drive circuit supplies pulses of current thereto via electrodes 208*a* and 208*b*. When the ink reaches the bubbling temperature, the ink inside ink chamber 202 bubbles by film boiling.

Heating element 209*a* elastically deforms at a temperature approximately equal to the bubbling temperature of the ink so that it slightly projects into ink chamber 202. When the current is supplied to heating element 209*a* and the ink reaches the bubbling temperature, the ink gives off bubbles. Immediately after bubbling, heater portion 209 including heating element 209*a* elastically deforms.

Protective film 209*b* is to prevent adherence of ink in ink chamber 202 to heating element 209*a* and electrodes 208*a* and 208*b*. Protective film 209*b* is preferably formed of polyimide, silicon oxide, silicon nitride, or the like.

Insulation film 209*c* provides electric insulation of heating element 209*a* and electrodes 208*a* and 208*b* from substrate 206. Insulation film 209*c* is preferably formed of silicon oxide, silicon nitride or the like.

Formed in substrate 206 at the position under and opposing heater portion 209 is a void 210. This void 210 communicates with the exterior of ink-jet head 201 via a hole 211 formed in substrate 206 at a position opposing heater portion 209. Provision of void 210 reduces the contact area of the undersurface of heater portion 209 with substrate 206. Accordingly, heat transfer of the heat generated from heater element 209*a* of heater portion 209 toward substrate 206 is reduced, while the ink inside ink chamber 202 is quickly heated as the temperature of heater portion 209 increases rapidly.

Further, provision of hole 11 equalizes the pressure inside void 210 to that outside ink-jet head 201. Therefore, when heater portion 209 elastically deforms, pressure inside void 210 will not lower, so as to permit heater portion 209 to elastically deform smoothly.

Heater portion 209 is fixed at the entire periphery of void 210 formed in substrate 206. Therefore, when heater portion 209 is elastically deformed, the ink inside ink chamber 202 will not leak to void 210 or other parts.

Figure 20:
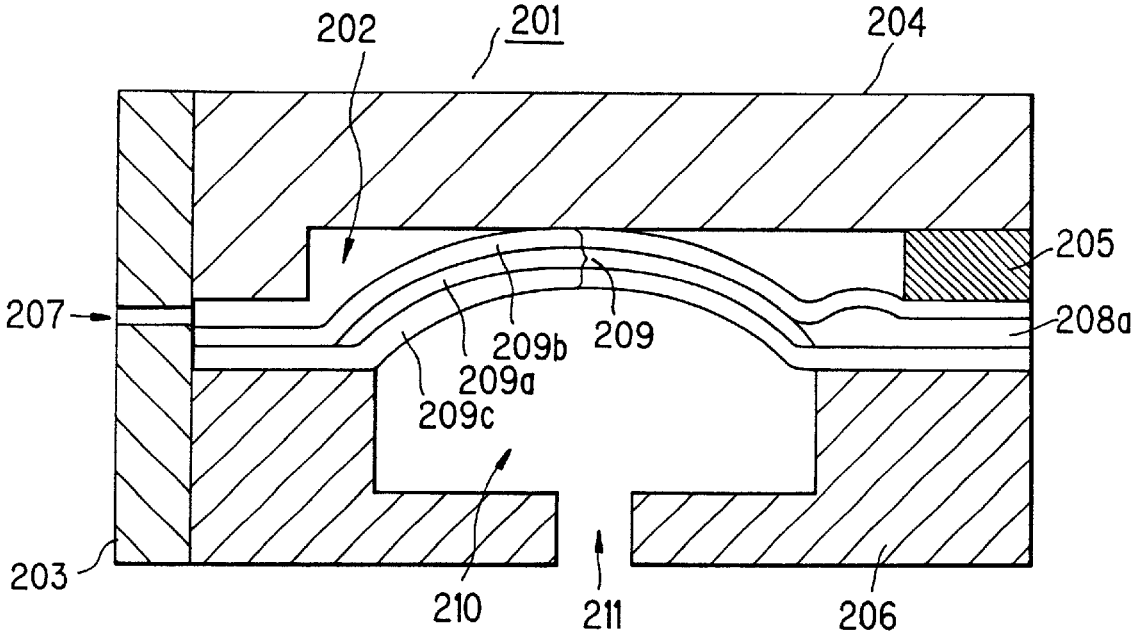
FIG. 20 is a sectional view showing the ink-jet head according to the ninth embodiment of the present invention, where the heater portion has been elastically deformed.

Next, the operation of the ink-jet head according to the ninth embodiment of the present invention will be described with reference to FIGS. 19B and 20. FIG. 20 is a sectional view showing the state where heater portion 209 has been elastically deformed. In FIG. 19B, as a pulse current is supplied to heating element 209*a*, the ink inside ink chamber 202 heats in an instant. When the temperature of heating element 209*a* reaches the bubbling temperature of the ink, ink gives off bubbles therein. Then, immediately after this, heating element 209*a* reaches its buckling temperature, heater portion 209 flexes into ink chamber 202 in an instant by thermal stress, and comes into contact with top plate 204, as shown in FIG. 20. As heater portion 209 abuts top plate 204, heat arising from heating element 209*a* of heater portion 209 is dissipated and directly conducted through top plate 204. As stated above, top plate 204 is of metal and hence has a good heat radiation performance, so that it discharges heat quickly.

When the current supplied to heating element 209*a* is stopped, the temperature of heater portion 209 sharply lowers. With the reduction in temperature, the thermal stress acting on heater portion 209 decreases, so that heater portion 209 reverts back to its original state shown in FIG. 19B by its own elasticity.

By the above operation, the pressure produced by the expansion of bubbles arising from the ink heated by heating element 209*a* and the pressure produced when heater portion 209 elastically deforms act on the ink. Since heating element 209*a* has a substantially circular shape as stated already, so that with the same area, the heating element 209*a* of this embodiment is more liable to elastically deform than one having a rectangular shape, for example. Therefore, the configuration of this embodiment provides efficient ejection of ink droplets from ejection nozzle 207.

Since heater portion 209 has a so-called diaphragm configuration which is fixed around the entire periphery of void 210, all the pressure arising in ink chamber 202 will act on the ink so as to eject ink droplets out.

Therefore, if the bubbles produced by heating element 209*a* are small in size compared to the conventional configuration, the pressure produced by the expansion of bubbles and the pressure produced when heater portion 209 elastically deforms act on the ink, thus making it possible to eject a required amount of ink from ejection nozzle 207. Resultantly, heating element 209*a* may be made compact compared to the conventional one and can reduce the power consumption required for heating element 209*a* to give off bubbles from the ink.

In this way, since heater portion 209 is cooled down quickly as the heat arising therefrom is released through top plate 204, this configuration provides a good response to the pulse current supplied to heating element 209*a*. Therefore, it is possible to control the ejected amount of ink at a high accuracy.

Figure 21:
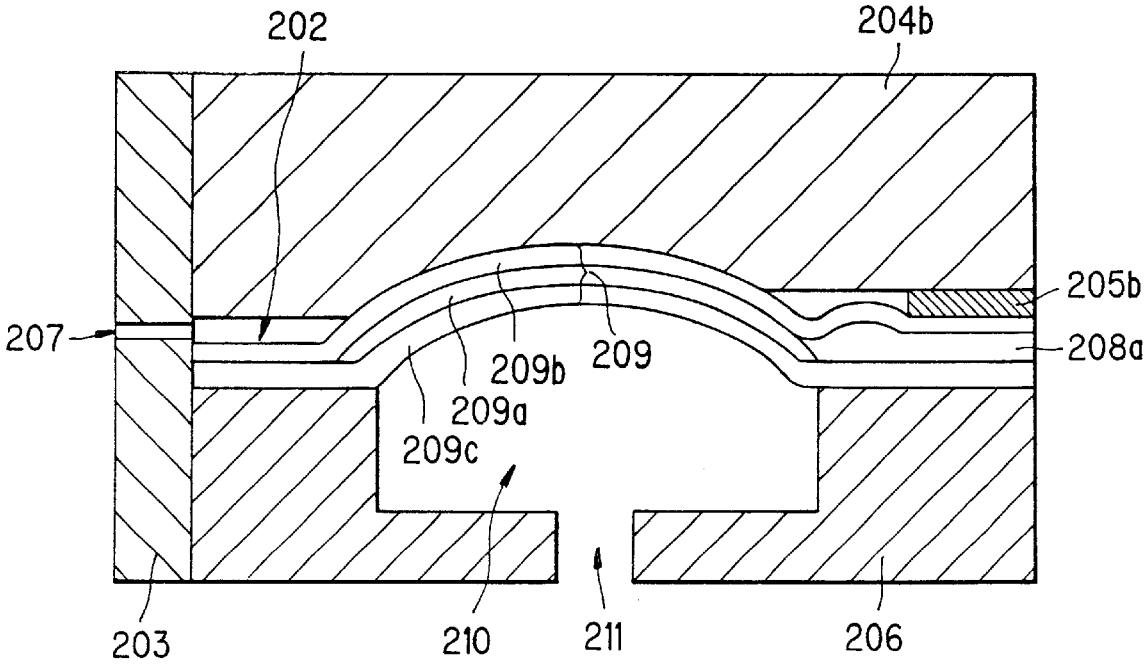
FIG. 21 is a sectional view showing a variational configuration of an ink-jet head according to the ninth embodiment of the present invention.

FIG. 21 is a sectional view showing another configuration of an ink-jet head according to the ninth embodiment of the present invention. As shown in FIG. 21, a top plate 204*b* opposing heater portion 209 having heating element 209*a* is shaped in a form similar to the deformed shape of heating portion 209 and arranged so that heater portion 209 will come into area contact with top plate 204*b* when heating portion 209 has elastically deformed by thermal stress.

When a pulse current is supplied to heater portion 209 and the temperature reaches the temperature causing elastic deformation, heater portion 209 elastically deforms so that the face opposing top plate 204*b* comes into area contact with top plate 204*b*. As a result, heat from heater portion 209 transfers to top plate 204*b* of metal, and is quickly dissipated through top plate 204*b*. Accordingly, when the current supplied to heater portion 209 is stopped, the heater portion immediately reverts back to its original state shown in FIG. 19B.

Figure 22:
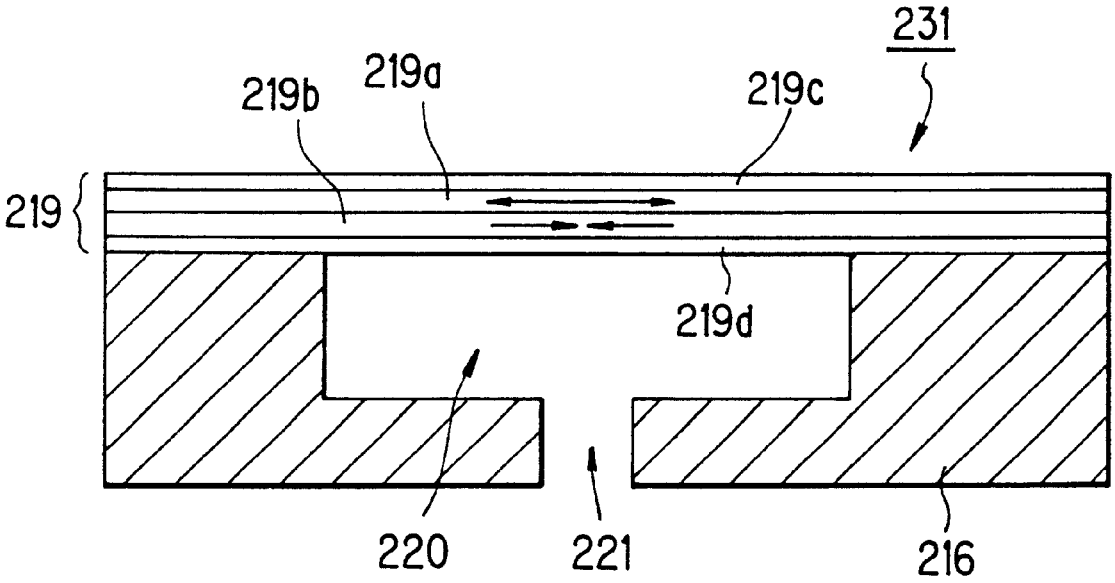
FIG. 22 is a sectional view showing an ink-jet head according to the ninth embodiment of the present invention with another heater portion configuration.

FIG. 22 is a sectional view showing another configuration of a heater portion 209 in an ink-jet head according to the ninth embodiment of the present invention. Since the configurations other than the heater portion are the same as in the ink-jet head 201 shown in FIGS. 19A and 19B, only the heater portion will be explained.

In an ink-jet head 231, in order to regulate the direction of deformation of heater portion 219, the heating element is provided in a multi-layered configuration to adjust the stress therein. Illustratively, heater portion 219 has a two layered structure of a heating element 219*a* (upper layer) and a heating element 219*b* (lower layer), which have been previously given compressive stress and tensile stress, respectively. Further, a protective film 219*c* is formed on the upper side of heating element 219*a* while an insulation film 219*d* is formed on the lower side of heating element 219*b*. Protective film 219*c* is to prevent adherence of ink in an unillustrated ink chamber to heating element 219*a* and unillustrated electrodes. Insulation film 219*c* provides electric insulation of heating element 219*b* and the unillustrated electrodes from a substrate 216.

In the case where heater portion 219 has a multi-layered structure with each layer given a different internal stress. when a temperature rise causes compressive stresses to arise, heater portion 219 will buckle with its center projected to the side on which the layer, among the multiple layers in heater portion 219, receiving a stronger compressive stress is disposed. In order for heater portion 219 to establish a stabilized state by deformation canceling out the differential stress between the layers, the layer which has a stronger compressive stress acting thereon compared to the other layers should expand greater and hence the heater portion 219 will curve with the layer having the greater expansion outside.

Therefore, with a temperature rise due to heating of heating elements 219*a* and 219*b*, heater portion 219 always elastically deforms with heating element 219*a*, which has a greater compressive stress acting thereon compared to that on the heating element 219*b*, projected so that heater portion 219 will positively come into contact with or come closer to top plate 204.

In heater portion 219 shown in FIG. 22, for example, electrolytic plating in a nickel amidosulfonate bath for plating with the current density of 40 mA/cm$^2$ is effected over heating element 219*b* of 3 $\mu$m thick, to form a lower layer. Then, electrolytic plating with the current density of 1 mA/cm$^2$ is effected over heating element 219*a* of 3 $\mu$m thick, to form an upper layer. In this case, a tensile stress of about 55 MPa is given to the lower layer of heating element 219*b*, while a compressive stress of about 55 MPa is given to the upper layer of heating element 219*a*. Therefore, when heating to a temperature nearly equal to the bubbling temperature, heater portion 219 deforms toward top plate 204.

In the ink-jet head designated at 231 shown in FIG. 22, heater portion 219 is formed in a multi-layered configuration with compressive and tensile stresses given to heating elements 219*a* and 219*b*, respectively. Also in ink-jet head 201 shown in FIGS. 19 and 20, when protective film 209*b* and insulation film 209*c* are given compressive and tensile stresses respectively while heating element 209*a* is adjusted to be free from stress, it is possible to cause heater portion 209 to elastically deform when the heater reaches a temperature nearly equal to the bubbling temperature.

Though, in ink-jet head 231 shown in FIG. 22, heater portion 219 is formed in a two-layered structure, it is also possible to have the same effects if the heater portion is formed in three or more layers, by adjusting the internal stress to be previously given to each layer.

Figures 23A, 23B, 23C, 23D, 23E, 23F, 23G, 23H:
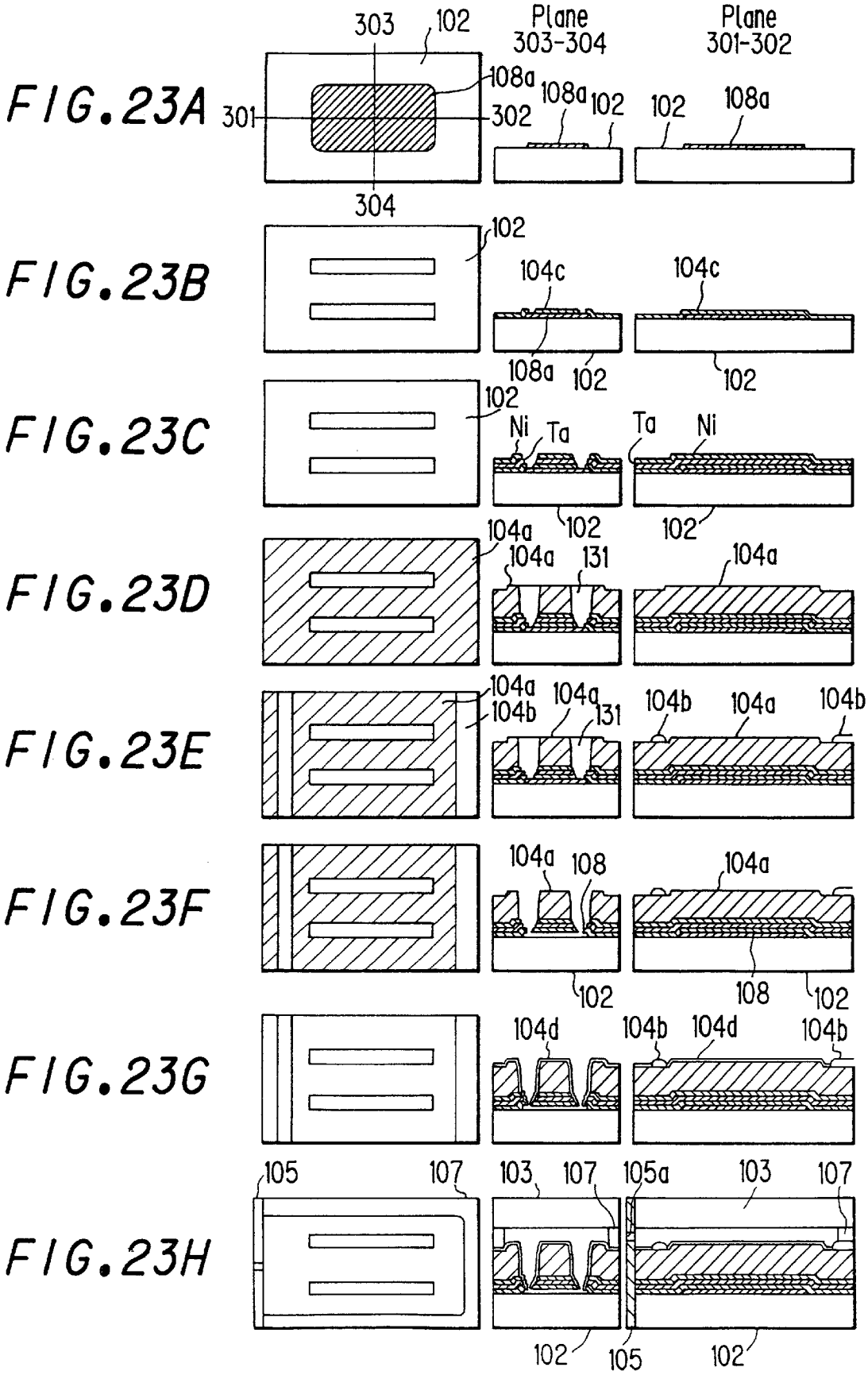
FIGS. 23A to 23H are views showing a fabrication method of an ink-jet head of the seventh embodiment of the present invention.

FIGS. 23A to 23H are views showing a fabrication method of an ink-jet head of the seventh embodiment of the present invention. For each of FIGS. 23A to 23H, the plan view, the sectional view taken along a plane 303–304 in the plan view and the sectional view taken along a plane 301–302 in each step are shown from the left to the right. When ink-jet head 101 of the seventh embodiment of the present invention is manufactured, a void-forming material 108*a* of polyimide, Al or the like is formed with a thickness (e.g., 5 $\mu$m) corresponding to the depth of void 108 to be formed, over the top surface of first substrate 102 of glass or metal by a spinner, sputtering or other means. Then, a photoresist corresponding to the plan shape of void 108 is patterned over the top surface. Void-forming material 108*a* is etched by a 1N NaOH solution or the like leaving the flat shape of void 108. Then the photoresist remaining on the top of the plan shape of void 108 is removed. By this process, a solid shape of void 108 is formed on the top surface of substrate 102 by void-forming material 108*a* (FIG. 23A).

Next, $SiO_2$ or the like is film formed by sputtering or other means so as to provide an insulation film 104*c* having a predetermined thickness (e.g., 0.1 $\mu$m) over the top of substrate 102 having the solid shape of void-forming material 108*a* for void 108. Then, dry etching such as RIE (reactive ion etching) with $CF_4$ gas is performed using a photoresist. Then the photoresist is removed. By this process, insulation film 104*c* is formed over the top surface of substrate 102 except part of the top surface of void-forming material 108*a* (FIG. 23B).

Subsequently, Ta of 100 Å thick and Ni of 200 Å thick are film formed by sputtering or other means in this order on the top surface of substrate 102 including void-forming material 108*a* and insulation film 104*c*. Then, etching is performed using a photoresist and then the photoresist is removed. By this process, Ta film for improving the adhesion between insulation film 104*a* and Ni forming heating element 104*a* and an Ni film for the surface backing of Ni plating forming heating element 104*a* are formed over top surface of substrate 102 except part of the top surface of void-forming material 108*a* (FIG. 23C). Here, it should be noted that insulation film 104*c*, Ta film and Ni film are formed on the top of the void-forming material in such a manner that the area of each layer in the plan view becomes marginally smaller than the area of the lower layer, whereby heating element 104*a* to be formed on the top of the Ni film will be positively coated by insulation film 104*c*.

Thereafter, a negative type photoresist is applied with the same thickness (e.g., 6.5 $\mu$m) as the film thickness of heating element 104*a* over the top surface of substrate 102 having the void-forming material, insulation film 104*c*, the Ta film, the Ni film formed thereon, and then the shape corresponding to the solid shape of heating element 104*a* to be formed is patterned. Use of a negative type photoresist is by reason of its suitability of forming tapering shapes for heating element 104*a*. Next, the Ni film is formed by electroytically plating in a nickel amidosulfonate bath having a pH of 4.4 with the current density set at 20 mA/cm$^2$ at a temperature of 50° C. so as to form an Ni layer having the thickness of heating element 104*a* in the area other than a photoresist 131 patterned over the top surface of substrate 102 (FIG. 23D). As shown in FIG. 17, no internal stress will occur in the Ni layer formed by the electroytically plating under the above-mentioned conditions.

Further, a photoresist pattern for interconnections are formed on the top surface of the Ni layer. Then, electroytic plating in a nickel amidosulfonate bath is peformed under predetermined conditions with the Ni layer used as the electrode, so as to form interconnections 104*b* for heating element 104*a* with a predetermined thickness (e.g., 10 $\mu$m) over the top surface of the Ni layer (FIG. 23E).

The substrate 102 having heating element 104*a* and interconnections 104*b* formed thereon by the above process is immersed in a 1N NaOH solution so as to remove photoresist 131 and void-forming material 108*a*. By this process, void 108 having the depth corresponding to the film thickness of void-forming material 108*a* is formed in the portion opposing the bottom face of heating element 104*a* on the top surface of substrate 102 (FIG. 23F).

Next, a film of $SiO_2$, SiN or the like having a predetermined thickness (e.g., 0.1 $\mu$m) is formed as protective film 104*d* by sputtering, vapor deposition or other methods, over the top surface of the Ni layer with photoresist 131 and void-forming material 108*a* removed, except on the top surface of interconnections 104*b*. Then the photoresist over interconnections 104*b* is removed by the lift-off method using acetone etc., or other methods. This completes the formation of heater portion 104 on substrate 102 (FIG. 23G).

Thereafter, polyimide, dry film etc. are formed with a predetermined shape having a predetermined thickness (e.g., 10 $\mu$m) over the top of part of interconnections 104*b* and part of protective film 104*d* to form spacing wall 107. Then, second substrate 103 of glass etc., is bonded to the top surface of spacing wall 107. Further, nozzle plate 105 having a nozzle 105*a* formed therein is bonded to the end face of substrates 102 and 103. This completes ink-jet head 101 in accordance with the seventh embodiment of the present invention (FIG. 23H).

Figure 24A:
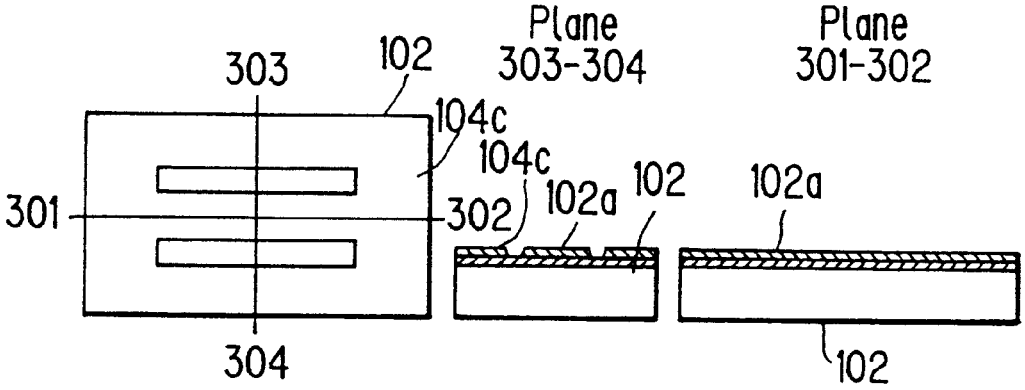
FIGS. 24A and 24B are views showing another fabrication method of an ink-jet head of the seventh embodiment of the present invention.
Figure 24B:
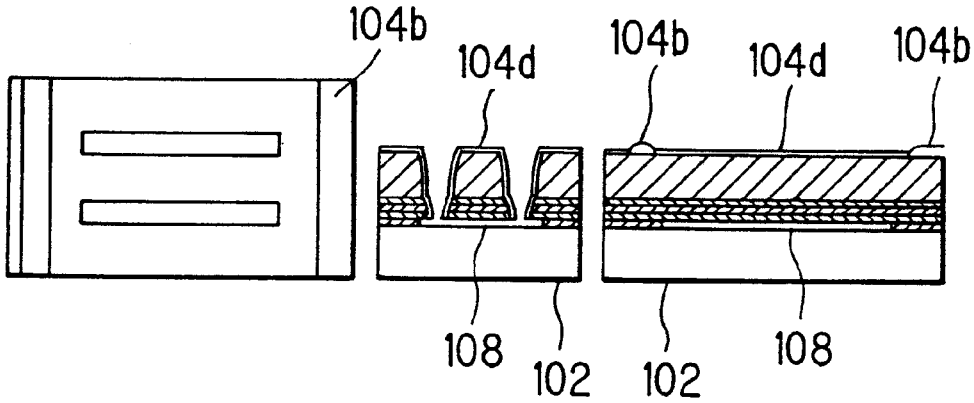

FIGS. 24A and 24B are views showing another fabrication method of an ink-jet head of the seventh embodiment of the present invention. For each of FIGS. 24A to 24B, the plan view, the sectional view taken along a plane 303–304 in the plan view and the sectional view taken along a plane 301–302 in each step are shown from the left to the right. In this fabrication method, insulation film 104*c* is formed (FIG. 24A) on a first substrate 102 made up of Si, of which the top surface is entirely covered with a thermal oxidation film 102*a*, in the same manner as shown in FIG. 23B. Then in the same manner as shown in FIGS. 23C to 23E, Ta film, Ni film, Ni layer and interconnections 104*b* constituting heater portion 104 are formed in this order. Then, thermal oxidation film 102*a* on the surface of substrate 102 in the lower part of heater portion 104 is removed by etching with hydrofluoric acid (HF) so as to form void 108 between substrate 102 and heater portion 104 (FIG. 24B). Here, insulation film 104*c* and protective film 104*d* needs to be composed of SiN so as not to be etched by HF.

According to this production method, void 108 can be formed without providing void-forming material 108*a*, thus making it possible to simplify the production process of ink-jet head 101 and hence reduce the cost. Since the film thickness of thermal oxidation film 102*a* formed on the top surface of substrate 102 can be controlled to be 1 $\mu$m or below, it is possible to set the depth of void 108 to be relatively shallow, thus making it possible to improve the heat radiation efficiency. Further, since it is easy to uniformly form thermal oxidation film 102*a* over the top surface of substrate 102, improved production yiled can be obtained.

Figure 25A:
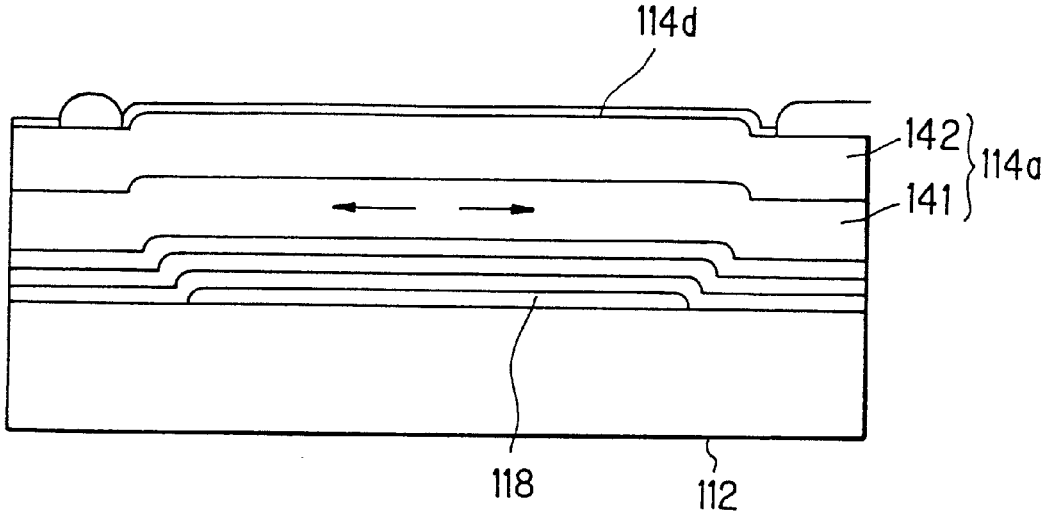
FIGS. 25A, 25B and 25C are views for illustrating a fabrication method of an ink-jet head of the eighth embodiment of the present invention.
Figure 25B:
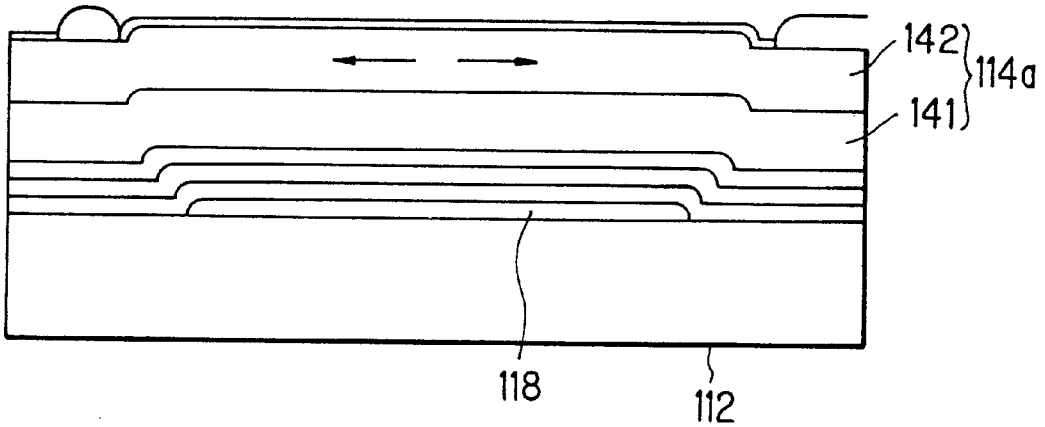
Figure 25C:
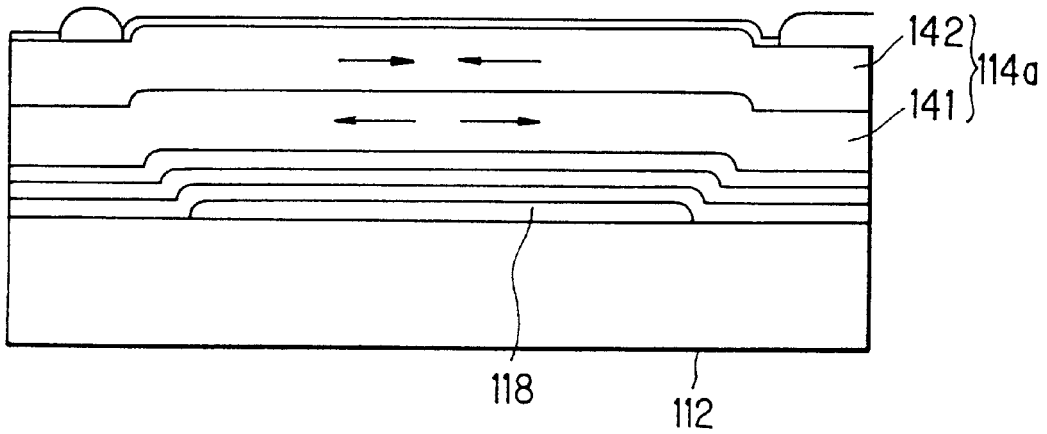

FIGS. 25A, 25B and 25C are views showing a fabrication method of an ink-jet head of the eighth embodiment of the present invention. When ink-jet head 111 according to the eighth embodiment wherein heater portion 114 is provided with multiple layers having different internal stresses is produced, the electrolytic plating process for the Ni layer constituting heating element 104*a* shown in FIG. 23D is effected by multiple steps using different current densities from one another, which are controlled based on the relationship shown in FIG. 17.

When the electrolytic plating process shown in FIG. 23D is performed by the combination of the first step for preparing a first layer 141 of 3.5 $\mu$m thick with a current density of 1 mA/cm$^2$ and the second step for preparing a second layer 142 of 3.0 $\mu$m thick with a current density of 20 mA/cm$^2$, heater portion 114 is formed with the first layer 141 located on the lower part given with a compressive stress of about 55 MPa and the second layer 142 located on the upper part given with no internal stress. By this process, the compressive stress acting on first layer 141 in the heated, heater portion 114 becomes greater than the compressive stress acting on second layer 142, so that heater portion 114 will always deform projected downwards so that the middle part of heater portion 114 will positively come into contact with the top surface of substrate 112 when it is heated.

In contrast, when the electrolytic plating process is performed by the combination of the first step for preparing a first layer 141 of 3.5 $\mu$m thick with a current density of 20 mA/cm$^2$ and the second step for preparing a second layer 142 of 3.0 $\mu$m thick with a current density of 1 mA/cm$^2$, heater portion 114 is formed with the second layer 142 located on the upper part given with a compressive stress of about 55 MPa and the first layer 141 located on the lower part given with no internal stress. By this process, the compressive stress acting on second layer 142 in the heated, heater portion 114 becomes greater than the compressive stress acting on first layer 141, so that heater portion 114 will always elastically deform projected upwards.

In this way, depending upon the structure and the state of attachment of ink-jet head 111, if an unillustrated upper substrate position above heater portion 114 has a greater heat radiation effect than that of substrate 112 located below heater portion 114, the heater portion 114 may be adapted to deform toward the upper substrate. That is, by controlling the current density during the electrolytic plating process for preparation of heating portion 114, it is possible to make heater portion 114 deform toward either substrate 112 or the upper substrate, taking into account the efficiency of heat radiation.

Finally, when the electrolytic plating is performed by the combination of the first step for preparing a first layer 141 of 3.5 $\mu$m thick with a current density of 1 mA/cm$^2$ and the second step for preparing a second layer 142 of 3.0 pm thick with a current density of 40 mA/cm$^2$, heater portion 114 is formed with the first layer 141 located on the lower part given with a compressive stress of about 55 MPa and the second layer 142 located on the upper part given with a tensile stress of about 55 MPa. By this process, the compressive stress acting on first layer 141 in the heated, heater portion 114 becomes markedly greater than the compressive stress acting on second layer 142, the middle part of heater portion 114 will positively come into contact with the top surface of substrate 112.

The present invention provides the effects as follows:

According to the first feature, in an ink-jet head ejecting ink in which a heating element is energized and heated so as to heat and bubble ink to thereby eject ink, a void is arranged between the heating element and the head substrate so that the heating element will buckle into the void by thermal expansion accompanying the temperature rise thereof. Therefore, heat diffusion from the heating element is prevented by the insulating effect of the void when ink is heated, enabling its sharp temperature rise. After ink ejection, the heating element buckles so that heat from the heating element is released through the head substrate to lower the temperature of the heating element rapidly, thus providing reliable ink ejection control.

According to the second feature of the present invention, since the heating element is composed of a heater, a protective film for protecting the heater, and an insulation film for insulating the heater and the above components are formed of materials having approximately equal coefficients of linear expansion to each other. Therefore, it is possible to prevent occurrence of cracks due to repeated heat cycles.

According to the third feature, since the heating element is arranged with its movement constrained at both ends with respect to the direction of the thickness and the direction perpendicular to the thickness, it is possible to positively cause the heating element to buckle toward the void.

According to the fourth feature, since the heating element is configured so as to come into contact with the head substrate when buckled into the void, heat from the heating element can be well dissipated through thermal conduction via its contact with the head substrate, whereby it is possible to achieve high accuracy control of the ejected amount of ink.

According to the fifth feature, since the void is arranged so as to communicate with a cavity that stores ink, the ink functions as the heat transfer medium when the heating element release heat thus improving the heat transfer to the head substrate and hence enabling beneficial heat radiation.

According to the sixth feature, since the head substrate has a communication hole for establishing communication between the void and the exterior, heat inside the void can be released outside through the communication hole, thus improving the heat radiation efficiency of the heating element.

According to the seventh feature, in an ink-jet head ejecting ink in which a heating element is energized and heated so as to heat and bubble ink to thereby eject ink, a void is arranged between the heating element and the head substrate, and the heating element is provided in a bimetal configuration made up of multiple kinds of metals so as to cause the heating element to deform into the void by the temperature rise thereof. Therefore, the direction of deformation of the heating element can be determined simply with the achievement of reliable deformation into the void, thus providing high accuracy control of the ejected amount of ink.

According to the eighth feature, in an ink-jet head ejecting ink in which a heating element is energized and heated so as to heat and bubble ink to thereby eject ink, a void is arranged between the heating element and the head substrate, and the heating element is formed with a shape memory alloy layer which will deform into the void when the heating element exceeds a predetermined temperature. Therefore, the direction of deformation of the heating element can be determined simply with the achievement of reliable deformation into the void, thus providing high accuracy control of the ejected amount of ink.

According to the ninth feature, in an ink-jet head ejecting ink in which a heating element is energized and heated so as to heat and bubble ink to thereby eject ink, a void is arranged between the heating element and the head substrate, and the ink-jet head further includes a piezoelectric actuator which pushes and deforms the heating element toward the void. Therefore, the direction of deformation of the heating element can be determined simply with the achievement of reliable deformation into the void, thus providing high accuracy control of the ejected amount of ink.

According to the tenth feature, the heating element arranged out of contact with the first and second substrates can be elastically deformed by thermal stress during heating into contact with the first or second substrate. Thereby, the heat generated in the heating element will not dissipate through the substrate while the heating element heats, thus making it possible to efficiently heat the ink in contact with the heating element. On the other hand, heat remaining in the heating element after the completion of heating of the heating element will be dissipated through the first or second substrate in contact, thus making it possible to cool down the heating element quickly, which results in improvement of the ink ejection response to the print data.

According to the eleventh feature, since the heating element is quickly deformed by elastic buckling when the heating element reaches the predetermined temperature, the heating element can be set quickly closer to or brought into contact with the first or second substrate in response to the temperature change, thus making it possible to cool down the heating element rapidly.

According to the twelfth feature, since the heating element which has elastically deformed by its own heat comes into area contact with the first or second substrate, a large amount of heat can be released from the heating element through the first or second substrate in contact, thus making it possible to cool down the heating element quickly, which leads to improvement of the ink ejection response to the print data.

According to the thirteenth feature, the heating element is fixed at both ends with respect to at least one direction within its surface opposing the first or second substrate so that the heating element will not be moved at both ends by thermal deformation during heating. Thereby, the mid part of the heating element can be moved closer to or into contact with the first or second substrate by the elastic deformation arising during heating, thus making it possible to positively release heat remaining in the heating element by way of the substrate.

According to the fourteenth feature, the heating element is fixed at the entire periphery of its surface opposing the first or second substrate and held between the first and second substrates so that the heating element will not be moved at the periphery thereof by thermal deformation during heating. Thereby, the central part of the heating element can be moved closer to or into contact with the first or second substrate by the elastic deformation arising during heating, thus making it possible to positively release heat remaining in the heating element by way of the substrate.

According to the fifteenth feature, the heating element is brought closer to or brought into contact with the first or second substrate by elastic deformation when the ink has been heated approximately close to the bubbling temperature. Thereby, it is possible to cool down the heating element by the heat radiation of the first or second substrate immediately after the ejection of bubbling ink from the nozzle. Therefore, it is possible to prevent the temperature of the heating element from lowering before completion of the ink ejection, which leads to improvement of the ink ejection response to the print data.

According to the sixteenth feature, the heating element before heating has been previously given a residual stress causing compression with respect to one direction within the surface thereof opposing the first or second substrate. Thereby, the heating element can be elastically deformed in a reliable manner by the thermal stress arising in the compressing direction during heating. Further, this configuration also contributes to lowering the temperature of the heating element to cause the heating element itself to be elastically deformed into the predetermined shape, thus making it possible to reduce the power consumption.

According to the seventeenth feature, the heating element is provided in the form of a plate having a multi-layered configuration in which an internal stress has been given previously in its unheated state so as to determine the direction of elastic deformation when the heating element heats. Therefore, the heating element will positively deform in the predetermined direction when it is heated.

According to the eighteenth feature, the heating element for heating the ink and giving off bubbles in order to eject the ink from the ejection will elastically deform toward the interior of the ink chamber when it is activated and reaches the predetermined temperature. Therefore, the pressure arising when bubbles expand and the pressure arising when the heating element elastically deforms act on the ink and hence the ink droplets can be ejected outside the ink-jet head by the combined pressure. This configuration contributes to reduce the current to be supplied to the heating element to bubble the ink, thus making it possible to reduce the power consumption.

According to the nineteenth feature, the void which is formed below the heating element provided in the ink chamber, functions as the insulation layer when the heating element heat by supplying a pulse of current. Therefore, heat diffusion from the heating element to the substrate can be inhibited, thus enabling sharp temperature rise of the heating element, which leads to improved efficiency of ink ejection.

According to the twentieth feature, since the void provided below the heating element is made in communication with the exterior of the ink-jet head, it is possible to prevent reduction in the pressure in the void, which enables smooth elastic deformation of the heating element.

According to the twenty-first feature, when the heating element is heated and reaches the predetermined temperature by supplying electric current, the heating element elastically deforms by thermal stress and comes into contact with the surface of the ink chamber opposing the heating element. Therefore, heat arising in the heating element is released through the abutment of the heating element with the surface of the in chamber opposing the heating element, thus making it possible to cool the heating element quickly after the generation of bubbles. As a result, an improved heating and cooling response to the selectively activated pulse current can be achieved, thus making it possible to control the ejected amount of ink with high precision.

According to the twenty-second feature, the heating element having been elastically deformed by heating is brought into area contact with the opposing surface which opposes the heating element. Therefore, the heating element can be brought into contact with the surface opposing the heating element through an enlarged area, thus improving the heat radiation efficiency and enabling rapid cooling of the heating element.

According to the twenty-third feature, since in the heating element having a multi-layered configuration, the outermost layer facing the interior of the ink chamber has been previously given an internal stress causing compression, the heating element can be always deformed elastically in the fixed direction when the heating element is heated by supplying current and reaches the elastically deforming temperature.

According to the twenty-fourth feature, since the heating element provided in the ink chamber is fixed at the entire periphery thereof to the bottom face of the ink chamber, it is possible to positively deform the heating chamber towards the interior of the ink chamber when it elastically deforms from heating. It is also possible to eject ink without any leakage of ink from the periphery of the heating element when the elastic element elastically deforms.

According to the twenty-fifth feature, since the heating element arranged in the ink chamber is formed in an approximately circular shape, this configuration provides large displacement of the heating element when it is elastically deformed, compared to other shapes having the same area. Therefore, it is possible to apply a greater pressure on the ink in the ink chamber.

According to the twenty-sixth feature, since a void can be formed between the heating element and the first substrate by removing the void-forming material from the top surface of the first substrate after the formation of the heating element, it is possible to easily fabricate an ink-jet head having a void between the first substrate, and the second substrate and the heating element.

According to the twenty-seventh feature, since the heating element is formed as a plated layer by electrolytic plating so as to previously give an internal stress causing compression to the heating element, it is possible to easily fabricate an ink-jet head having a heating element which can be elastically deformed in a reliable manner.

According to the twenty-eighth feature, since the heating element is formed by electrolytic plating using different current densities which affect the internal stresses to be given to the plated layers, it is possible to easily fabricate an ink-jet head having a heating element which can elastically deform in the predetermined direction in a reliable manner when it is heated.

What is claimed is:

1. An ink-jet head for ejecting ink by heating and bubbling ink, comprising:

a heating element to which electric current is supplied so as to heat and bubble the ink; and a head substrate having a void formed between the heating element and the head substrate, wherein the heating element buckles into the void by thermal expansion accompanying a temperature rise of the heating element.

2. The ink-jet head according to claim 1, wherein the heating element comprises: a heater; a protective film for protecting the heater; and an insulation film for insulating the heater, wherein the above components are formed of materials having approximately equal coefficients of linear expansion to each other.

3. The ink-jet head according to claim 1, wherein the heating element contacts the head substrate when said heating element is buckled into the void.

4. The ink-jet head according to claim 1, wherein the void is arranged so as to communicate through an opening with a cavity that stores ink.

5. The ink-jet head according to claim 1, wherein the head substrate has a hole which communicates between the void and an exterior portion of the ink-jet head.

6. The ink-jet head of claim 1, wherein said heating element includes a lamination of a plurality of metals designed and adapted so as to urge the heating element into a buckled position extending into the void when the temperature of the heating element rises.

7. The ink-jet head of claim 1, wherein said heating element includes a shape memory alloy layer designed and adapted so as to urge the heating element into a buckled position extending into the void when the temperature of the heating element exceeds a predetermined temperature.

8. The ink-jet head according to claim 1, wherein the heating element is arranged with its movement constrained at both ends with respect to a longitudinal direction of the heating element and a direction perpendicular to the longitudinal direction.

9. An ink-jet head for ejecting ink from a nozzle by heating and bubbling ink, comprising:

a first substrate;

a second substrate arranged opposing the first substrate, wherein a space between said first and said second substrates is filled with ink; and a heating element disposed between the first and second substrates and having a voltage selectively applied thereto so that the ink inside the space is heated and bubbled, wherein the heating element is arranged between the first and second substrates with clearances from both, and wherein the heating element comes closer to or contacts the first or second substrate by elastic deformation occurring from thermal stress during heating.

10. The ink-jet head according to claim 9, wherein the elastic deformation is elastic buckling that occurs when the temperature of the heating element reaches a predetermined temperature.

11. The ink-jet head according to claim 9, wherein the first or second substrate has an opposing surface which contacts the heating element when the heating element is elastically deformed.

12. The ink-jet head according to claim 9, wherein the heating element is a plate fixed at opposing ends with respect to at least one direction parallel to the surface of the plate opposing the first or second substrate.

13. The ink-jet head according to claim 12, wherein the heating element is a plate fixed at an entire periphery of the surface thereof opposing the first or second substrate, and held between the first and second substrates.

14. The ink-jet head according to claim 9, wherein the heating element elastically deforms by thermal stress arising at a temperature approximately equal to the bubbling temperature of the ink.

15. An ink-jet head for ejecting ink comprising:

an ejection nozzle for ejecting ink;

an ink chamber defined by at least one surface and arranged in communication with the ejection nozzle; and a heating element disposed in the ink chamber, which forms bubbles in ink which contacts the heating element and which causes ink ejection from the ejection nozzle by pressure arising when the bubbles expand, wherein the heating element elastically deforms toward the ink chamber when the heating element reaches a predetermined temperature.

16. The ink-jet head according to claim 15, wherein the heating element defines one surface of a void.

17. The ink-jet head according to claim 16, wherein the void communicates through an opening with an exterior portion of the ink-jet head.

18. The ink-jet head according to claim 15, wherein the heating element abuts the at least one surface of the ink chamber opposing the heating element when the heating element reaches the predetermined temperature.

19. The ink-jet head according to claim 18, wherein the ink chamber has an opposing surface which opposes and contacts the heating element when the heating element is elastically deformed.

20. The ink-jet head according to claim 15, wherein the heating element is fixed at an entire periphery thereof to a bottom face of the ink chamber.

21. The ink-jet head according to claim 15, wherein the heating element is essentially circular in shape.

* * * * *